US008369748B2

(12) United States Patent
Ueno et al.

(10) Patent No.: US 8,369,748 B2
(45) Date of Patent: Feb. 5, 2013

(54) IMAGE FORMING APPARATUS WITH DEVELOPING CARTRIDGE HAVING ENGAGING PORTION

(75) Inventors: Takahito Ueno, Mishima (JP); Shigeo Miyabe, Numazu (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 12/551,029

(22) Filed: Aug. 31, 2009

(65) Prior Publication Data

US 2010/0054806 A1 Mar. 4, 2010

(30) Foreign Application Priority Data

Sep. 1, 2008 (JP) ..... 2008-223404

(51) Int. Cl.
*G03G 15/01* (2006.01)
*G03G 15/08* (2006.01)

(52) U.S. Cl. ..... 399/227; 399/119

(58) Field of Classification Search ..... 399/227, 399/228, 119

See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,463,446 | A | 10/1995 | Watanabe et al. | 355/200 |
| 5,585,889 | A | 12/1996 | Shishido et al. | 355/200 |
| 5,640,650 | A | 6/1997 | Watanabe et al. | 399/117 |
| 5,839,028 | A | 11/1998 | Nomura et al. | 399/109 |
| 5,873,012 | A | 2/1999 | Miyabe et al. | 399/90 |
| 5,878,309 | A | 3/1999 | Nomura et al. | 399/111 |
| 5,878,310 | A | 3/1999 | Noda et al. | 399/117 |
| 5,926,666 | A | 7/1999 | Miura et al. | 399/25 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,567 | A | 10/1999 | Matsuzaki et al. | 399/111 |
| 6,029,031 | A | 2/2000 | Yokomori et al. | 399/109 |
| 6,064,843 | A | 5/2000 | Isobe et al. | 399/111 |
| 6,072,968 | A | 6/2000 | Nomura et al. | 399/113 |
| 6,128,452 | A | 10/2000 | Miyabe et al. | 399/90 |
| 6,137,975 | A | 10/2000 | Harumoto | 399/227 |
| 6,154,623 | A | 11/2000 | Suzuki et al. | 399/111 |
| 6,173,140 | B1 | 1/2001 | Suzuki et al. | 399/113 |

(Continued)

FOREIGN PATENT DOCUMENTS

| | | |
|---|---|---|
| EP | 1 403 735 | 3/2004 |
| JP | 9-68911 | 3/1997 |

(Continued)

*Primary Examiner* — Susan Lee

(74) *Attorney, Agent, or Firm* — Fitzpatrick, Cella, Harper & Scinto

(57) ABSTRACT

An image forming apparatus forming an image on a recording material includes an image bearing member; a rotary rotatably provided in a main assembly of the apparatus; a locking member; and a developing cartridge detachably mounted to the rotary, wherein the developing cartridge includes a developer carrying member for developing a latent image formed on the image bearing member, a demountably mounted covering member for covering a surface of the developer carrying member, and an engaging portion which is movable between a first position in which it is projected beyond an outer surface of the covering member to engage with the main assembly locking member when the rotary is rotated in a forward direction which is a direction of rotation during image formation, and a second position in which it is retracted from the outer surface of the covering member.

14 Claims, 13 Drawing Sheets

U.S. PATENT DOCUMENTS

| | | | | |
|---|---|---|---|---|
| 6,215,969 | B1 | 4/2001 | Nomura et al. | 399/111 |
| 6,282,390 | B1 | 8/2001 | Miyabe et al. | 399/111 |
| 6,317,572 | B1 | 11/2001 | Miyabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,603,939 | B1 | 8/2003 | Toba et al. | 399/103 |
| 6,678,488 | B2 | 1/2004 | Toba et al. | 399/111 |
| 6,795,666 | B2 | 9/2004 | Miyabe et al. | 399/109 |
| 6,836,629 | B2 | 12/2004 | Miyabe et al. | 399/111 |
| 6,931,226 | B2 | 8/2005 | Chadani et al. | 399/109 |
| 6,934,485 | B2 | 8/2005 | Miyabe et al. | 399/90 |
| 6,983,115 | B2 | 1/2006 | Isobe et al. | 399/119 |
| 7,136,604 | B2 | 11/2006 | Chadani et al. | 399/90 |
| 7,149,457 | B2 | 12/2006 | Miyabe et al. | 399/114 |
| 7,155,141 | B2 | 12/2006 | Sato et al. | 399/114 |
| 7,158,736 | B2 | 1/2007 | Sato et al. | 399/111 |
| 7,164,875 | B2 | 1/2007 | Miyabe et al. | 399/111 |
| 7,184,690 | B2 | 2/2007 | Ueno et al. | 399/117 |
| 7,212,768 | B2 | 5/2007 | Numagami et al. | 399/111 |
| 7,224,925 | B2 | 5/2007 | Sato et al. | 399/263 |
| 7,248,810 | B2 | 7/2007 | Miyabe et al. | 399/90 |
| 7,315,710 | B2 | 1/2008 | Ueno et al. | 399/117 |
| 7,450,877 | B2 | 11/2008 | Miyabe et al. | 399/90 |
| 7,499,663 | B2 | 3/2009 | Sato et al. | 399/106 |
| 2006/0039720 | A1* | 2/2006 | Miyazawa et al. | 399/227 |
| 2006/0269318 | A1 | 11/2006 | Ueno et al. | 399/106 |
| 2008/0152388 | A1 | 6/2008 | Ueno et al. | 399/167 |
| 2008/0260428 | A1 | 10/2008 | Ueno et al. | 399/167 |
| 2008/0286000 | A1 | 11/2008 | Kimizuka et al. | |
| 2008/0286004 | A1 | 11/2008 | Kimituka et al. | 399/119 |
| 2008/0286010 | A1* | 11/2008 | Aoki et al. | 399/227 |
| 2008/0286011 | A1* | 11/2008 | Aoki et al. | 399/227 |
| 2009/0047037 | A1 | 2/2009 | Miyabe et al. | 399/111 |
| 2009/0074454 | A1 | 3/2009 | Sato et al. | 399/113 |
| 2010/0054805 | A1 | 3/2010 | Numata et al. | |
| 2010/0054823 | A1 | 3/2010 | Takasaka et al. | |

FOREIGN PATENT DOCUMENTS

| | | |
|---|---|---|
| JP | 2000-19839 | 1/2000 |
| JP | 3203242 | 6/2001 |
| JP | 3809412 | 5/2006 |

* cited by examiner

IMAGE FORMING APPARATUS WITH DEVELOPING CARTRIDGE HAVING ENGAGING PORTION

FIELD OF THE INVENTION AND RELATED ART

The present invention relates to a developing device for visualizing a latent image formed on an image bearing member into a visualized image (toner image), more particularly to an image forming apparatus including a rotary type developing device in which a plurality of developing devices of a cartridge type are carried on a rotary.

The image forming apparatus includes an electrophotographic image forming apparatus, an electrostatic recording image forming apparatus, magnetic recording image forming apparatus and so on.

In an electrophotographic image forming apparatus, the use is made with an electrophotographic photosensitive member for an image bearing member, on which an electrostatic latent image is formed through an electrophotographic image forming process. Examples of the apparatus include an electrophotographic copying machine, an electrophotographic printer (LED printer, laser beam printer and so on), an electrophotographic printer type facsimile machine, an electrophotographic printer type word processor and so on.

In an electrostatic recording image forming apparatus, the use is made with a dielectric member for electrostatic recording as an image bearing member, on which an electrostatic latent image is formed through an electrostatic recording image forming process, and an image is formed on the recording material. A magnetic recording image forming apparatus uses a magnetic recording magnetic member as an image bearing member, on which a magnetic latent image is formed using a magnetic recording image forming process, and an image is formed on the recording material.

A developing cartridge is a unit containing at least a developer carrying member (developing member) such as a developing roller for developing a latent image formed on the image bearing member, and is detachably mountable to a main assembly of the apparatus. The main assembly of the apparatus is a part of the apparatus other than the developing cartridge.

The following description will be made as to an electrophotographic image forming apparatus as an exemplary image forming apparatus. In the electrophotographic image forming apparatus, the developer carrying member for developing the electrostatic latent image on the electrophotographic photosensitive member and a toner accommodating portion for accommodating a developer (toner) are unified into a cartridge. The cartridge is detachably mountable to the main assembly of the apparatus of the electrophotographic image forming apparatus (developing cartridge type).

With such a developing cartridge type, the operationality is enhanced, so that user can easily perform in effect the maintenance of the electrophotographic image forming apparatus. For this reason, the developing cartridge type is widely used in the field of electrophotographic image forming apparatus.

Recently, the demand for color electrophotographic image forming apparatuses capable of forming color images increases, an inexpensive color electrophotographic image forming apparatus for private users are desired.

In order to accomplish low cost color electrophotographic image forming apparatus, further downsizing would be necessary. Under the circumstances, a so-called rotary type color electrophotographic image forming apparatus provided with a rotary (rotatable member) capable of carrying a plurality of developing cartridge has been proposed. That is, a color electrophotographic image forming apparatus equipped with a rotary type developing device. The rotary type developing device supports a plurality of developing cartridges accommodating different color toner materials along a circumferential direction of the rotary. The rotating force is transmitted to the rotary by transmitting means from a driving source (motor). By doing so, the rotary is rotated to bring one of the developing cartridges to a developing position where the developing cartridge is opposed to the electrophotographic photosensitive member, and the electrostatic latent image formed on the electrophotographic photosensitive member is developed with the toner by the developing cartridge. The operations are repeated for the other developing cartridges, thus forming a color image on the recording material. The image forming apparatus employing the rotary type developing device is capable of forming a color image using only one small size image bearing member. For this reason, it is advantages from the standpoint of downsizing of the main assembly of the apparatus.

As for the color image forming apparatus detachably accommodating four color developing cartridges on a rotatable rotary, the developing cartridge may be mounted to or dismounted from the main assembly through a top opening provided by opening a cover, as disclosed in Japanese Patent No. *3203242, Japanese Patent No. *3809412. A part of the surface of the developing roller is exposed to outside at the mounting or dismounting.

Japanese Laid-open Patent Application 2000-19839 discloses a covering member protecting the developing roller otherwise exposed to prevent toner leakage during transportation of the main assembly of the apparatus. When a developer cartridge is to be mounted, a fixed member of the main assembly block the mounting opening is removed to enable the mounting. The covering member is disengaged in interrelation with removal of the fixed member of the main assembly.

Japanese Laid-open Patent Application Hei 9-68911 discloses a separate part exclusively for the removal to improve the exchanging operation property of the developing cartridge, the separate part being mounted to a part of the developing cartridge.

In view of the case where the user inadvertently fails to remove the covering member protecting the developing roller, Japanese Laid-open Patent Application 2000-19839 disposes that rotary is rotated from the mounting and demounting position to abut it to a flange portion of the image bearing member. In view of the case where the user having mounted the cover member in removing the developing cartridge inadvertently fails to remove it, Japanese Laid-open Patent Application Hei 9-68911 discloses that closing of the door is prevented.

SUMMARY OF THE INVENTION

The above-described conventional structure increases the operational burden of the user.

Accordingly, it is a principal object of the present invention to provide a developing device and an image forming apparatus with which the operation required of the user is minimized at the time of exchanging the developing cartridge.

It is another object of the present invention to provide a developing device and an image forming apparatus with which a user can be notified of the failure of removal of the covering member.

According to an aspect of the present invention, there is provided an image forming apparatus forming an image on a recording material, comprising an image bearing member; a rotary rotatably provided in a main assembly of the apparatus; a locking member; and a developing cartridge detachably mounted to said rotary, wherein said developing cartridge includes a developer carrying member for developing a latent image formed on said image bearing member, a demountably mounted covering member for covering a surface of said developer carrying member, and an engaging portion which is movable between a first position in which it is projected beyond an outer surface of said covering member to engage with said main assembly locking member when said rotary is rotated in a forward direction which is a direction of rotation during image formation, and a second position in which it is retracted from the outer surface of said covering member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described in detail with reference to the appended drawings.

(General Structure of Electrophotographic Color Image Forming Apparatus)

Figure 1:
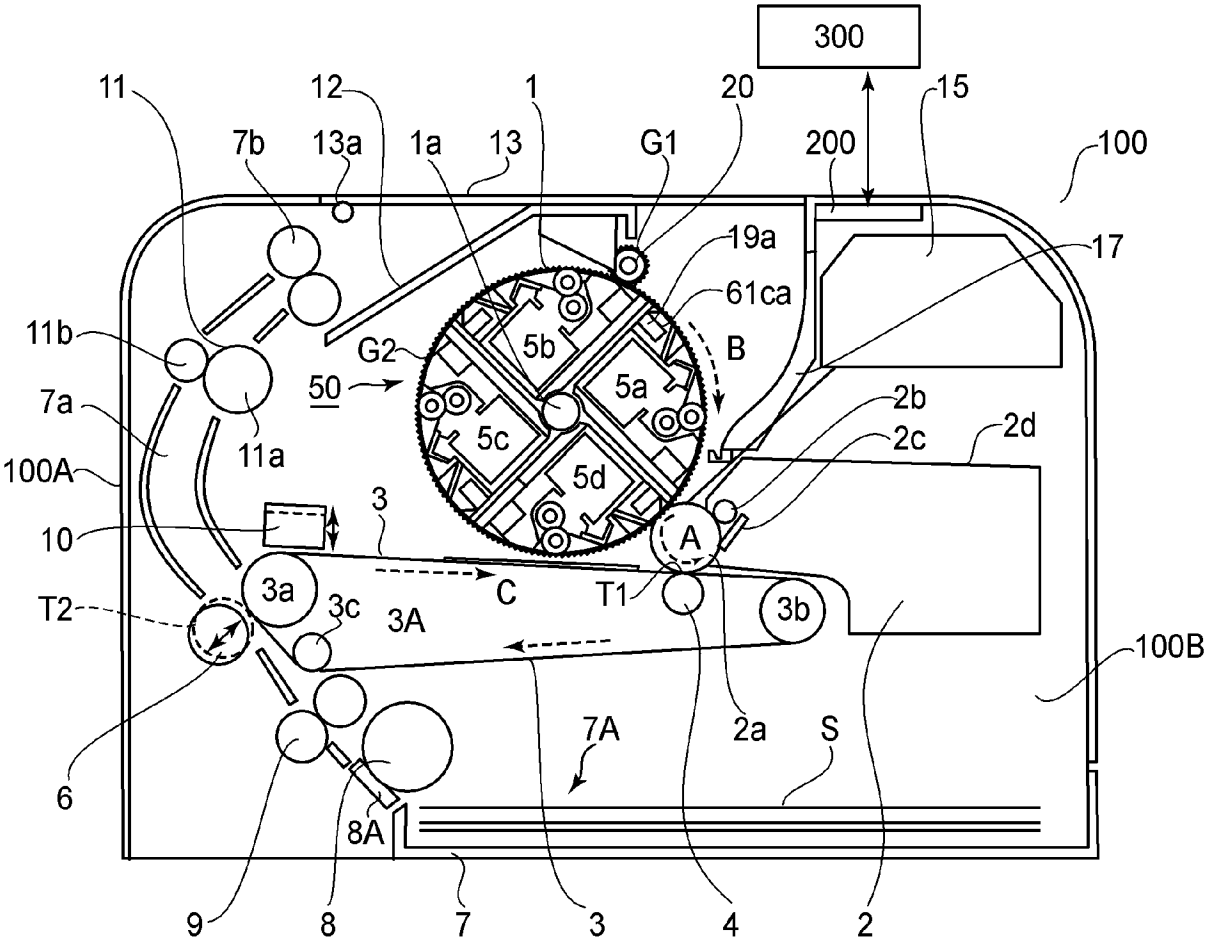
FIG. 1 is a schematic sectional view of an image forming apparatus according to an embodiment of the present invention in a stand-by state.

FIG. 1 is a vertical sectional view of the electrophotographic color image forming apparatus 100 (which hereafter will be referred to simply as image forming apparatus) in this preferred embodiment, at a plane perpendicular to the axial line of the photosensitive member of the image forming apparatus. It shows the general structure of the image forming apparatus. This image forming apparatus 100 is a full-color laser beam printer, which uses an electrophotographic image formation process based on four primary colors. That is, it forms an image on a recording medium S, in response to electrical image formation signals inputted into its control circuit 200 (controlling means, CPU) from a host apparatus 300, such as a personal computer, an image reader, a facsimile, etc. The recording medium S is in the form of a sheet of recording paper, an OHP sheet, a label, etc. The control circuit 200 exchanges various electrical information with the host apparatus 300, and the control portion (unshown) of the image forming apparatus 100. It also controls the general operations related to the image forming operation of the image forming apparatus 100, in accordance with a preset control program or a referential table. In other words, the image forming operation, which will be described next, is controlled by the control circuit 200.

There is an electrophotographic photosensitive drum 2*a* (which hereafter will be referred to simply as drum) in the image forming apparatus 100. The drum 2*a* is a rotatable image bearing member. It is rotationally driven by a driving mechanism (unshown) at a preset velocity (process speed) in the counterclockwise direction indicated by an arrow mark A drawn with a broken line. The image forming apparatus 100 also has multiple processing means for processing the drum 2*a*. The processing means are in the adjacencies of the peripheral surface of the drum 2*a*. In this embodiment, the processing means are: a charging means 2*b* for uniformly charging the drum 2*a*; an exposing means 15 for forming an electrostatic latent image on the peripheral surface of the drum 2*a* by selectively exposing numerous points on the uniformly charged portion of the peripheral surface of the drum 2*a*; and a developing means 50 for developing the latent image on the peripheral surface of the drum 2*a* into a visible image, with the use of developer (which hereafter may be referred to as toner). Further, the image forming apparatus 100 is provided with a drum cleaning means 2*c*, which is also in the adjacencies of the peripheral surface of the drum 2*a* to remove the toner remaining on the drum 2*a* after the primary transfer.

In this embodiment, the charging means 2*b* is a charge roller of the contact type, and the exposing means 15 is a laser scanner unit.

The developing means 50 is a developing apparatus of the so-called rotary type. That is, it has a rotary 1 (rotatable member) for supporting multiple (four) development cartridges 5*a*, 5*b*, 5*c*, and 5*d*, and is rotatable to sequentially move the development cartridges into the development position. In the case of the image forming apparatus 100 in this embodiment, an electrostatic image, which corresponds to one of the primary colors, is formed on the drum 2*a*, and is developed with the toner, which corresponds in color to the primary color, into a visible image. The developing means 50 has four development cartridges 5*a*, 5*b*, 5*c*, and 5*d*, which correspond to four primary colors, that is, yellow, magenta, cyan, and black, respectively. That is, the yellow (Y), magenta (M), cyan (C), and black (B) development cartridges hold yellow, magenta, cyan, and black toners, respectively. The rotary 1 is rotatable about is rotational shaft 1*a* (central axle). More specifically, referring to FIG. 4, a drive shaft 20 is driven by a driving force transmitting mechanism M (rotary driving electrical mechanism), and the rotational force is transmitted to the rotary gears G2 (G2L and G2R) by way of the drive gears G1 (G1L and G1R), respectively. Thus, the rotary 1 is rotated about the rotational shaft 1*a* in the clockwise direction indicated by an arrow mark B drawn with a broken line. Hereafter, the clockwise rotational direction B of the rotary 1 will be referred to as the positive direction (direction in which rotary is rotated during image forming operation). The control circuit 200 controls the driving force transmitting mechanism M so that the rotary 1 rotates by a preset angle calculated by the control circuit 200.

The drum cleaning means 2*c* is a cleaning means of the blade type. That is, it has a cleaning blade 2*c*, which acts on the drum 2*a* to remove the transfer residual toner (transfer residual developer). The toner removed from the peripheral surface of the drum 2*a* by the blade 2*c* is stored in a cleaning means container 2*d*.

In this embodiment, the drum 2*a*, charging means, 2*b*, and drum cleaning means 2*c* and 2*d* are integrated in the form of a drum cartridge 2, which is removably mountable in one of the predesignated cartridge chambers of the main assembly 100A of the image forming apparatus 100 through a preset procedure. However, the drum 2*a*, charging means 2*b*, and drum cleaning means 2*c* and 2*d* may be made independent from each other, instead of being integrated as they are in this embodiment.

The apparatus main assembly 100A is provided with an intermediary transfer unit 3A, which is a transferring means and is below the spaces for the drum cartridges 2 and developing means 50. This unit 3A has an endless intermediary transfer belt 3 (which hereafter may be referred to simply as belt), which is an intermediary transferring member proper. The belt 3 is formed of a dielectric material, and is flexible. The intermediary transfer unit 3A has also four rollers 3*a*, 4, 3*b*, and 3*c*, by and around which the belt 3 is suspended so that the belt 3 is provided with a preset amount of tension. The roller 3*a* is the roller which opposes a secondary transfer roller 6 with the presence of the intermediary transfer belt 3 between the roller 3*a* and secondary transfer roller 6. The roller 4 is the primary transfer roller, and is kept pressed upon the drum 2*a* with the presence of the belt 3 between the roller 4 and drum 2*a*. The rollers 3*b* and 3*c* are the belt driving roller and tension roller, respectively. The area of contact between the drum 2*a* and belt 3 is the primary transfer nip T1. The belt 3 is circularly driven by the belt driving roller 3*b* in the direction indicated by an arrow mark C drawn with a broken line, at a velocity which corresponds to the rotational velocity of the drum 2*a*.

The apparatus main assembly 100A is provided with the abovementioned secondary transfer roller 6, which is positioned so that it opposes the abovementioned secondary transfer roller 3*a* with the presence of the belt 3 between the two rollers 6 and 3*a*. The secondary transfer roller 6 can be positioned in two different positions by a secondary transfer roller moving mechanism (unshown). One of the two positions, which is indicated by a broken line, is the operational position, in which it remains in contact with the belt 3, with the presence of the secondary transfer roller 3*a*, which is in contact with the belt 3, on the opposite side of the belt 3 from the roller 6. The other position, which is indicated by a solid line, is the non-operational position, in which it remains separated from the belt 3. Normally, the secondary transfer roller 6 is kept in the non-operational position. It is moved into the operational position with preset control timing. The area of contact between the secondary transfer roller 6 and belt 3 when the secondary transfer roller 6 is in the operational position is the secondary transfer nip T2.

The apparatus main assembly 100A is also provided with a belt cleaner 10 (belt cleaning means), which is on the downstream side of where the secondary transfer rollers 6 opposes the secondary transfer roller 3*a*, in terms of the moving direction of the belt 3. The belt cleaner 10 is the means for removing the secondary transfer residual toner from the surface of the belt 3. It can be placed in two different positions by a belt cleaner moving mechanism (unshown). One of the positions, which is indicated by a broken line, is the operational position, in which the belt cleaner 10 remains in contact with the surface of the belt 3, and the other position, which is indicated by a solid line, is the non-operational position, in which it remains separated from the belt 3. Normally, the belt cleaner 10 is kept in the non-operational position. It is moved to the operational position with preset control timing.

Further, the apparatus main assembly 100A is provided with a recording medium conveyance unit 7A, which is below the intermediary transfer unit 3A. The unit 7A has a sheet feeder cassette 7, a feed roller 8, and a separation pad 8*a*. The recording sheets S are stored in layers in the sheet feeder cassette 7.

The apparatus main assembly 100A is also provided with a recording medium conveyance passage 7*a* (through which recording medium is conveyed), which extends upward from the feed roller 8 of the recording medium conveyance unit 7A. Located along the recording medium conveyance passage 7*a* in the order, in which they will be listed next, are a pair of registration rollers 9, the secondary transfer roller 6, a fixing device 11, and a pair of discharge rollers 7*b*, listing from the bottom side. The fixing device 11 has a fixation roller 11*a* and a pressure roller 11*b*. A part of the top surface of the top cover of the apparatus main assembly 100A is shaped so that it functions as a delivery tray 12.

The full-color image forming operation of this image forming apparatus is as follows. FIG. 1 shows the image forming apparatus when the apparatus is on standby. While the image forming apparatus 100 remains on standby, the rotary 1 remains stationary in its home position, in which the yellow development cartridge 5*a* faces frontward (rightward in FIG. 1). When the image forming apparatus 100 is in the condition shown in FIG. 1, the control circuit 200 waits for the inputting of an image formation start signal.

As an image formation start signal is inputted, the control circuit 200 begins to activate a main motor (unshown) to rotationally drive the drum 2*a*. Further, the driving force transmitting mechanism M is driven so that the rotary 1 is rotated by roughly 45° from the home position, shown in FIG. 1, in the positive direction B, about its rotational axle 1*a* by the driving shaft 20, gear G1, and gear G2. This rotation of the rotary 1 causes the yellow development cartridge 5*a* to move into the development position, in which the yellow development cartridge 5*a* is precisely positioned, as shown in FIG. 2; the development roller 51*a* of the yellow development cartridge 5*a* is placed in contact with the drum 2*a* in a preset manner.

In this embodiment, the development position is the position in which the development roller 51, which supplies the drum 2*a* with toner by bearing the toner, is placed in contact with the drum 2*a*. In order to ensure that when the development cartridge 5 is in the development position, the development roller 51 remains in contact with the drum 2*a*, the rotary 1 is kept under such a pressure that works in the direction to rotate the rotary 1 about the driving shaft 20 so that a given development cartridge 5 is in the development position, and its development roller 51 remains in contact with the drum 2*a* with the presence of a preset amount of pressure between the development roller 51 and drum 2*a*. That is, the rotary 1 is rotatable about the drive shaft 20 in an oscillatory manner, while holding the development cartridges 5, as will be described later. In other words, the rotary 1 is kept pressed toward the drum 2*a* by a pressing means (unshown), while being allowed to rotate about the drive shaft 20 in an oscillatory manner, so that when a given development cartridge 50 is in the development position, its development roller 51 remains in contact with the drum 2*a*, with the presence of a preset amount of contact pressure between the development roller 51 and drum 2*a*. The drive shaft 20 and drive gear G1 are coaxial. Incidentally, the state of contact between the development roller 51 and drum 2*a* includes such a state that a very minute gap is kept between the development roller 51 and drum 2*a* by a pair of spacer rings (unshown), with which the lengthwise end portions of the development roller 51 are fitted, one for one, in such a manner that they remain in contact with the drum 2*a*.

Figure 2:
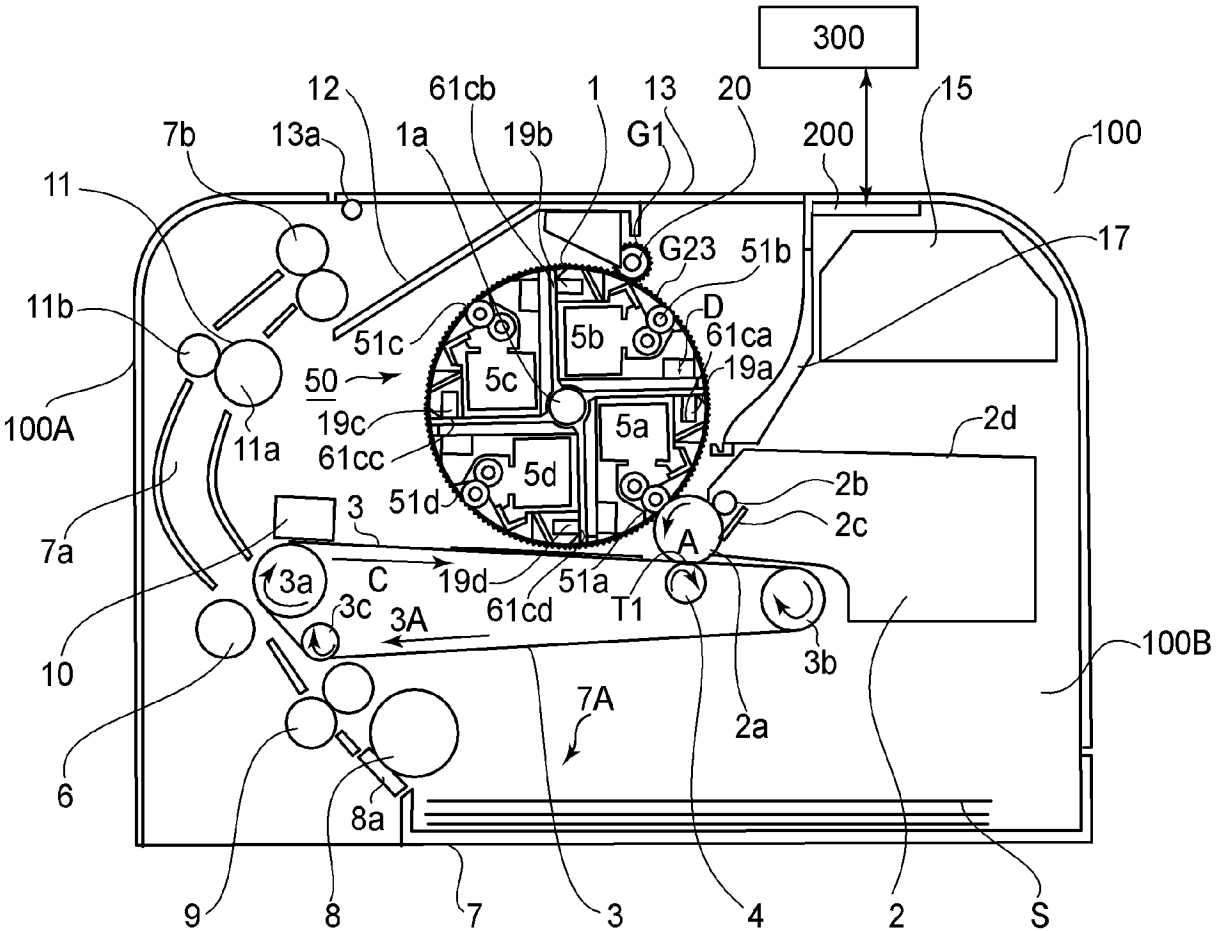
FIG. 2 is a schematic sectional view of the image forming apparatus in which a yellow developing cartridge is in developing operation.

Next, referring to FIG. 2, to the yellow development cartridge 5*a* which is in the development position, the development cartridge driving force and development bias are applied from the apparatus main assembly 100A. Further, the laser scanner unit 15 is driven, and the belt 3 is circularly driven. The secondary transfer roller 6 and belt cleaner 10 are kept in their non-operational positions, in which they remain separated from the belt 3. Further, a preset charge bias is applied to the charge roller 2*b*. Thus, the peripheral surface of the rotating drum 2*a* is uniformly charged to preset polarity and potential level. Then, the charged area of the peripheral surface of the drum 2*a* is scanned (exposed) by the beam of laser light outputted by the laser scanner unit 15 while being modulated with the image signals corresponding to the yellow component of the full-color image. As a result, an electrostatic latent image, which corresponds to the yellow component of the full-color image, is effected on the peripheral surface of the drum 2*a*. In this embodiment, the electrostatic latent image is developed in reverse with the use of negative toner, that is, toner which is the same in polarity as the polarity to which the drum 2*a* is charged. To the development roller 51*a*, a voltage (development bias) which is the same in polarity as the polarity to which the drum 2*a* is charged, is applied so that the yellow toner adheres to the electrostatic latent image on the drum 2*a*. Then, the developed image, that is, the toner image formed on the drum 2*a* of the yellow toner, is transferred (primary transfer) onto the surface of the belt 3, in the aforementioned primary transfer nip T1. To the primary transfer roller 4, the primary transfer bias, which is opposite in polarity to the toner and is preset in potential level, is applied with a preset control timing. After the primary transfer, the peripheral surface of the drum 2*a* is cleaned by the cleaning blade 2*c*.

After the completion of the primary transfer of the yellow toner image onto the belt 3, the control circuit 200 rotates the rotary 1 in the positive direction B by a preset angle, which in this embodiment is roughly 90°, by driving the driving force transmitting mechanism M. Thus, the magenta development cartridge 5*b* is moved into the development position, in which the magenta development cartridge 5*b* opposes the drum 2*a*; the magenta development cartridge 5*b* is precisely positioned in the development position, in which the development roller 51*b* of the magenta development cartridge 5*b* is placed in contact with the drum 2*a* in the preset manner. Then, the aforementioned charging process, exposing process, and developing process, which were carried out to form the yellow toner image on the drum 2*a*, are carried out to form a toner image, the color of which corresponds to the magenta (M) component of the full-color image. Then, the resultant magenta toner image is transferred (primary transfer) onto the belt 3, in the primary transfer nip T1, in such a manner that the magenta toner image is laid on the yellow toner image, in alignment with the yellow toner image on the belt 3.

After the completion of the primary transfer of the magenta toner image onto the belt 3, the control circuit 200 rotates the rotary 1 in the positive direction B by the preset angle, which in this embodiment is roughly 90°, by driving the driving force transmitting mechanism M. As a result, the cyan development cartridge 5*c* is moved into the development position, in which the cyan development cartridge 5*c* opposes the drum 2*a*; the cyan development cartridge 5*c* is precisely positioned in the development position, in which the development roller 51*c* of the cyan development cartridge 5*c* is placed in contact with the drum 2*a* in the preset manner. Then, the aforementioned charging process, exposing process, and developing process, which were carried out to form the yellow and cyan toner images on the drum 2*a*, are carried out to form a toner image, the color of which corresponds to the cyan (C) component of the full-color image. Then, the resultant cyan toner image is transferred (primary transfer) onto the belt 3 in the primary transfer nip T1, in such a manner that the cyan toner image is laid on the yellow and magenta toner images on the belt 3, in alignment with the yellow and magenta toner images on the belt 3.

After the completion of the primary transfer of the cyan toner image onto the belt 3, the control circuit 200 rotates the rotary 1 in the positive direction B by the preset angle, which in this embodiment is roughly 90°, by driving the driving force transmitting mechanism M. As a result, the black development cartridge 5*d* is moved into the development position, in which the black development cartridge 5*d* opposes the drum 2*a*; the black development cartridge 5*c* is precisely positioned in the development position, in which the development roller 51*d* of the black development cartridge 5*d* is placed in contact with the drum 2*a* in the preset manner. Then, the aforementioned charging process, exposing process, and developing process, which were carried out to form the yellow, cyan, and magenta toner images on the drum 2*a*, are carried out to form a toner image, the color of which corresponds to the black (B) component of the full-color image. Then, the resultant black toner image is transferred (primary transfer) onto the belt 3 in the primary transfer nip T1, in such a manner that the black toner image is laid on the yellow, magenta, and cyan toner images on the belt 3, in alignment with the yellow, magenta, and cyan toner images on the belt 3.

As a result, four monochromatic color images, more specifically, the monochromatic yellow, magenta, cyan, and black toner images, are placed in layers on the belt 3, synthetically forming an unfixed full-color image on the belt 3.

Incidentally, the order in which the aforementioned four monochromatic toner images, different in color, are formed on the drum 2*a*, does not need to be limited to the above described one (yellow toner image→magenta toner image→cyan toner image→black toner image). That is, the order is optional.

Figure 3:
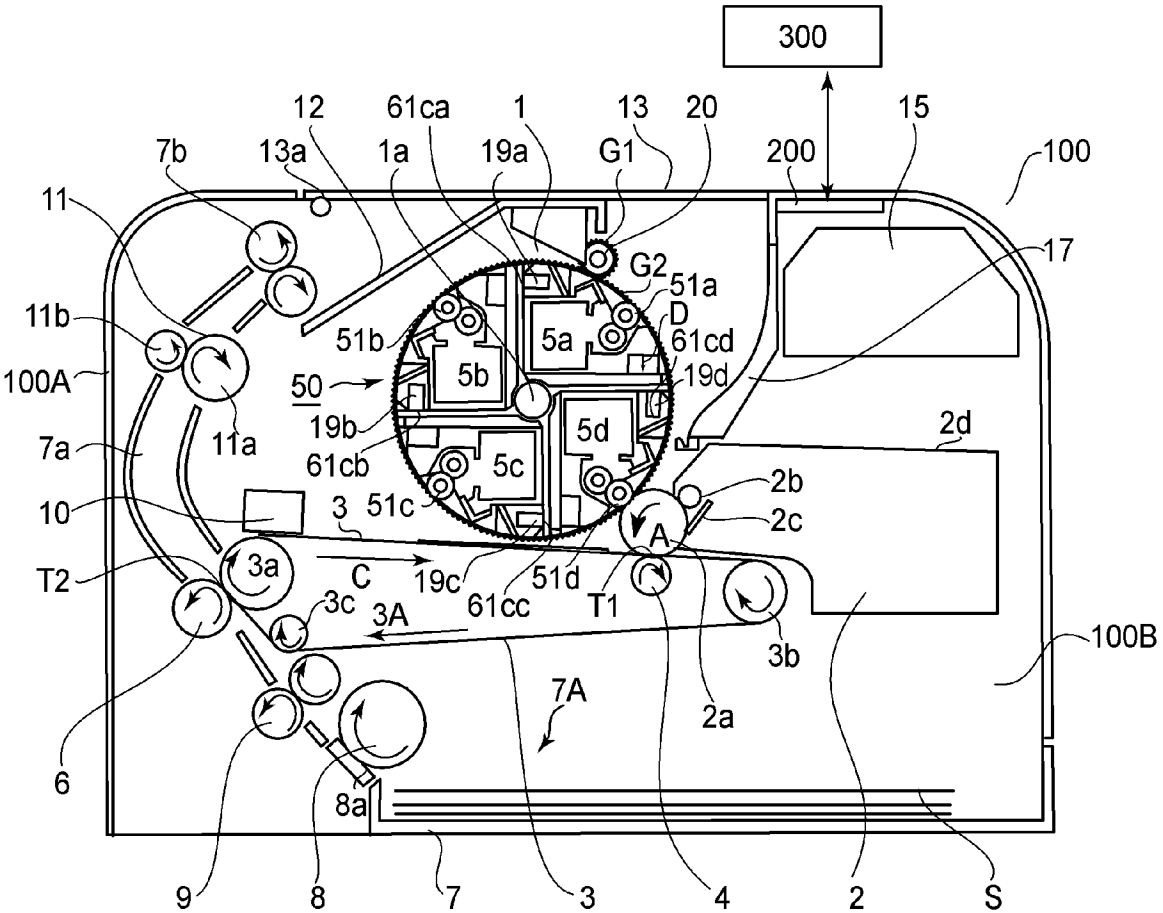
FIG. 3 is a schematic sectional view of the image forming apparatus in which a black developing cartridge is in developing operation.

Before the leading edge of the unfixed full-color image on the belt 3 is made to reach the position of the secondary transfer roller 6, by the movement of the belt 3, the secondary transfer roller 6 is moved into its operational position, in which it remains in contact with the belt 3. Further, the belt cleaner 10 is moved into its operational position, in which it cleans the belt 3. FIG. 3 shows the state of the image forming apparatus 100, in which the secondary transfer roller 6 and belt cleaner 10 are in their operational positions. In FIG. 3, the black development cartridge 5*d* is in the development position, in which it opposes the drum 2*a*.

Meanwhile, the feed roller 8 is driven with a preset control timing, whereby one of the recording sheets S stored in layers in the sheet feeder cassette 7, is separated from the rest, by the coordinated movement of the feed roller 8 and separation pad 8*a*, and is conveyed further into the apparatus main assembly 100A. As the recording sheet S is conveyed further into the apparatus main assembly 100A, it is introduced by the pair of registration rollers 9, into the secondary transfer nip T2, which is the area of contact between the secondary transfer roller 6 and belt 3, with preset control timing. To the secondary transfer roller 6, the secondary transfer bias, which is opposite in polarity to the charge of the toner, is applied. Thus, the four monochromatic toner images, which are different in color and have just been transferred in layers onto the belt 3, are transferred all at once (secondary transfer), starting from their leading edges, onto the recording sheet S while the recording sheet S is conveyed through the secondary transfer nip T2, remaining pinched by the secondary transfer roller 6 and belt 3.

Then, the recording sheet S is separated from the surface of the belt 3, and is introduced into the fixing device 11, in the fixation nip of which the recording sheet S is subjected to heat and pressured. As a result, the four toner images, different in color, on the recording sheet S become fixed to the recording sheet S; they melt, and adhere to the recording sheet S while mixing. After coming out of the fixing device 11, the recording sheet S is discharged, as a full-color print of the original full-color image, onto the top cover 12 by the pair of discharge rollers 7*b*.

The secondary transfer toner, that is, the toner remaining on the surface of the belt 3 after the separation of the recording sheet S from the belt 3, is removed by the belt cleaner 10.

To summarize the image forming operation described above, the rotary 1 by which the multiple development cartridges 5*a*, 5*b*, 5*c*, and 5*d*, which are different in developer color, are supported, is rotated so that the development cartridge 5, which is to be used for the next development operation, is moved into the development position, in which the development cartridge 5 opposes the drum 2*a*. Then, the electrostatic latent image formed on the drum 2*a* is developed by the development cartridge 5 into a toner image (developer image); the electrostatic latent image is developed into a visible image formed of the toner (developer). These procedures are repeated after each of the multiple development cartridges 5 is moved into the development position, to form four visible images formed of four toners (developer), different in color, and to transfer the four images onto the recording sheet S by the intermediary transfer member 3 so that a full-color image is formed on the recording sheet S.

As soon as an image formation job for yielding a single or multiple prints of the image is completed, the control circuit 200 puts the image forming apparatus 100 on standby, and waits for the next image formation start signal. That is, it stops driving the drum 2*a*, laser scanner unit 15, belt 3, etc., and moves the secondary transfer roller 6 and belt cleaner 10 into their nonoperational positions. Then, it rotates the rotary 1 into the home position of the rotary 1, shown in FIG. 1, and puts the image forming apparatus 100 on standby.

When the image forming apparatus 100 is operated in the black-and-white monochromatic image formation mode, only the black development cartridge 5*d* is used for image formation. As soon as a job for forming a singe black (monochromatic) print, or a job for continuously forming multiple black (monochromatic) prints, ends, the control circuit 200 puts the image forming apparatus 100 on standby, and waits for the next image formation start signal.

(Rotary)

Figure 4:
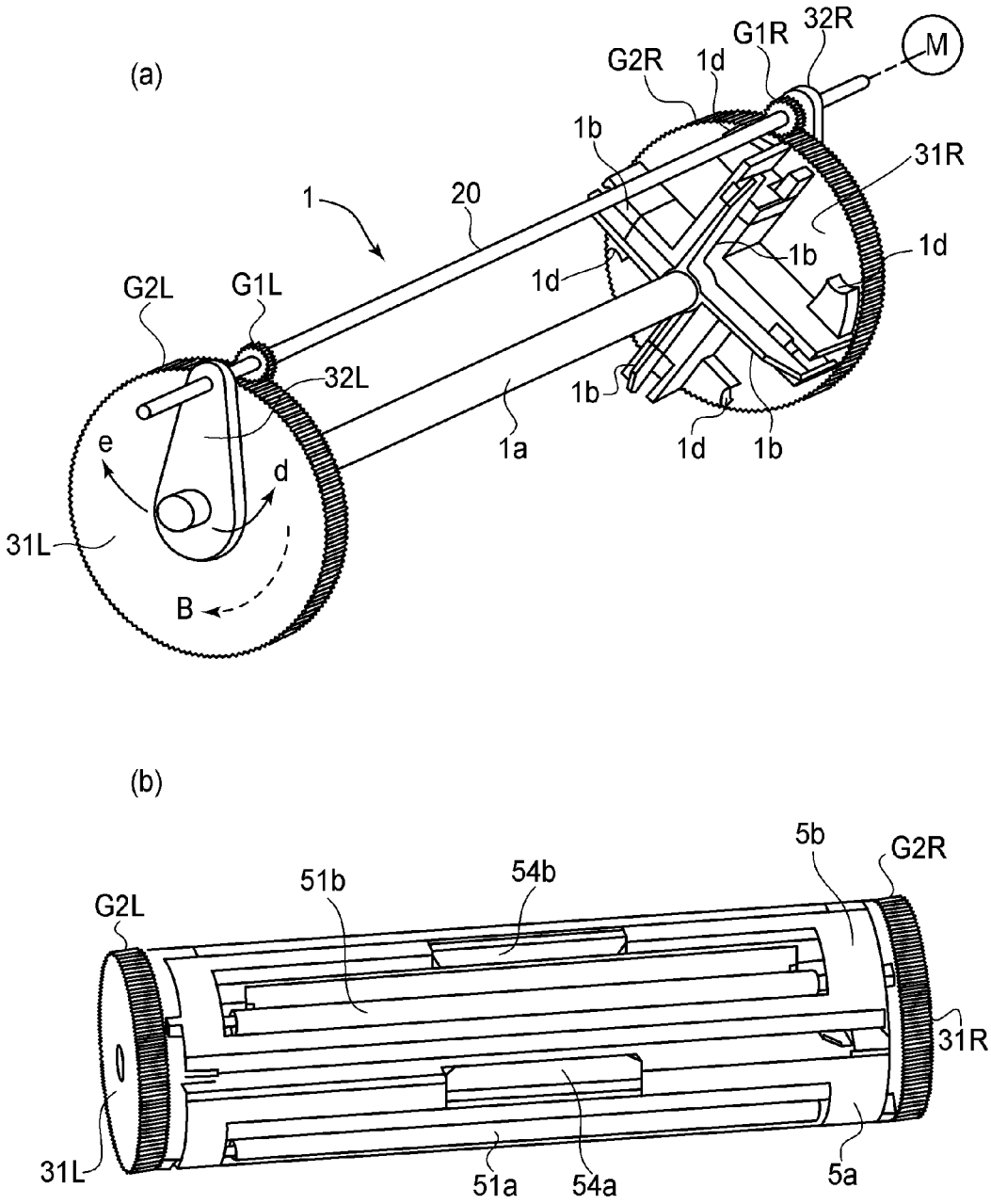
FIG. 4 is an illustration of a structure of a rotary.

Next, referring to FIG. 4, the rotary 1 in this embodiment will be described in structure. Referring to FIG. 4(*a*), the rotary 1 has a rotational shaft 1*a*, and a pair (left and right) lateral plates 31L and 31R. The lateral plates 31L and 31R are in the form of a disk, and are coaxially attached to the left and right end portions of the rotational shaft 1*a*, respectively. Each of the left and right disklike lateral plates 31L and 31R is provided with four cartridge supporting portions for removably supporting the development cartridges 5*a*, 5*b*, 5*c*, and 5*d* by their lengthwise ends, one for one. The four cartridge supporting portions are separated from the adjacent cartridge supporting portions by roughly 90° in terms of the rotational direction of the rotary 1. Further, the apparatus main assembly 100A is provided with the drive shaft 20, which is rotatably supported between the left and right lateral plates of the main frame 100B of the apparatus main assembly 100A, by the bearings (unshown). Further, there are a pair of rotary suspending arms 32L and 32R, which are rotatably fitted around the left and right end portions of the drive shaft 20, with the presence of a pair of bearings (unshown) between the arms 32L and drive shaft 20 and between the 32R and drive shaft 20, respectively. The rotary 1 is supported by the pair of rotary suspending arms 32L and 32R, between them; the left and right end portions of the rotational shaft 1*a* of the rotary 1 are supported with the pair of rotary suspending arms 32L and 32R, with the presence of bearings between the lengthwise left end portion of the rotational shaft 1*a* and the arm 32L, and between the lengthwise right end portion of the rotational shaft 1*a* and the arm 32R, respectively. Next, referring to FIGS. 1-3, and FIG. 4(*b*), the aforementioned four development cartridge 5*a*, 5*b*, 5*c*, and 5*d* are removably mounted in the predesignated cartridge spaces, one for one, between the disklike left and right side plates 31L and 31R of the rotary 1, in a manner of collectively forming a virtual cylinder. The peripheral edge of each of the left and right disklike side plates 31L and 31R is provided with teeth, forming thereby a rotary gear G2 (G2L or G2R). The left and right end portions of the drive shaft 20 are solidly fitted with a pair of drive gears G1L and G1R (left and right gears, respectively), which are in mesh with the left and right rotary gears G2L and G2R, respectively. The drive shaft 20 is rotationally driven by the driving force transmitting mechanism M, which is controlled by the control circuit 200.

With the presence of the above described structural arrangement, as the drive shaft 20 is driven in the preset direction by the driving force transmitting mechanism M, the rotational force is transmitted from the drive shaft 20 to the rotary gears G2L and G2R by way of the drive gears G1L and G1R, respectively, whereby the rotary 1 is rotated about the rotational shaft 1*a* in the positive direction B. The control circuit 200 controls the driving force transmitting mechanism M so that the rotary 1 is rotated by a precalculated angle.

The rotary 1 is suspended from the drive shaft 20 by the left and right rotary suspending arms 32L and 32R, being thereby enabled to arcuately move in the counterclockwise direction indicated by an arrow mark d, or the clockwise direction indicated by an arrow mark e. The counterclockwise direction d is the direction in which the rotary 1 is arcuately moved when the rotary 1 is to be moved toward the drum 2*a*, whereas the clockwise direction e is the direction in which the rotary 1 is arcuately moved when the rotary 1 is to be moved away from the drum 2*a*. Moreover, the rotary 1 is kept pressured in the counterclockwise direction indicated by the arrow mark d by a pressure applying means, such as a spring, so that the rotary 1 rotates about the drive shaft 20. Thus, as a given development cartridge 5 is moved into the development position by the preset (calculated) amount of rotation of the rotary 1, the peripheral surface of the development roller 51 of this development cartridge 5 is placed, and kept placed, in contact with the peripheral surface of the drum 2*a*, with no gap between the development roller 51 and drum 2*a*, by the pressure from the pressure applying means; the development roller 51 is kept in contact with the drum 2*a* so that a preset amount of contact pressure is maintained between the development roller 51 and drum 2*a*.

Incidentally, the left and right drive gears G1L and G1R, which mesh with the left and right rotary gear G2L and G2R of the rotary 1, are attached to the drive shaft 20, about which the rotary 1 arcuately oscillates, in such a manner that the gears G1L and G1R are coaxial with the drive shaft 20. Therefore, even when the rotary 1 arcuately oscillates, the gears G1L and G1R remain meshed with the rotary gears G2L and G2R, respectively.

As described before, the rotary 1 is structured to hold four development cartridges 5, that is, the yellow, magenta, cyan, and black development cartridges 5*a*, 5*b*, 5*c*, and 5*d*, respectively, in such a manner that when the four cartridges 5 are in their predesignated positions in the rotary 1, the combination of the rotary 1 and four cartridges 5 roughly looks like a cylinder. The four development cartridge supporting portions of the rotary 1 are the same in structure. Thus, the structural arrangement for the rotary 1 to support the development cartridge will be described with reference to the yellow development cartridge supporting portion of the rotary 1. Referring to FIGS. 1-3, as the yellow development cartridge 5*a* is mounted into the rotary 1, the rotary engaging portion 61*ca*, with which the yellow development cartridge 5*a* is provided, engages with the development cartridge engaging member 19*a*, with which the rotary 1 is provided. This structural arrangement prevents the yellow development cartridge 5*a* from popping out of the rotary 1. The development cartridge engaging member 19*a* is under the pressure generated by a spring (unshown) in the direction (indicated by arrow mark D in FIG. 2) to cause the member 19*a* to be engaged with the yellow development cartridge 5*a*. The magenta, cyan, and black cartridges 5*b*, 5*c*, and 5*d*, respectively, are also provided with their rotary engaging members 61*cb*, 61*cc*, and 61*cd*, which engage with the development cartridge engaging members 19*b*, 19*c*, and 19*d*, respectively, whereby the magenta, cyan, and black development cartridges 5*b*, 5*c*, and 5*d* are prevented from popping out of the rotary 1.

(Structure of Development Cartridge 5)

The yellow, magenta, cyan, and black development cartridges 5*a*, 5*b*, 5*c*, and 5*d*, respectively, are the same in structure, although they are different in the color of the toner they contain.

Figure 5:
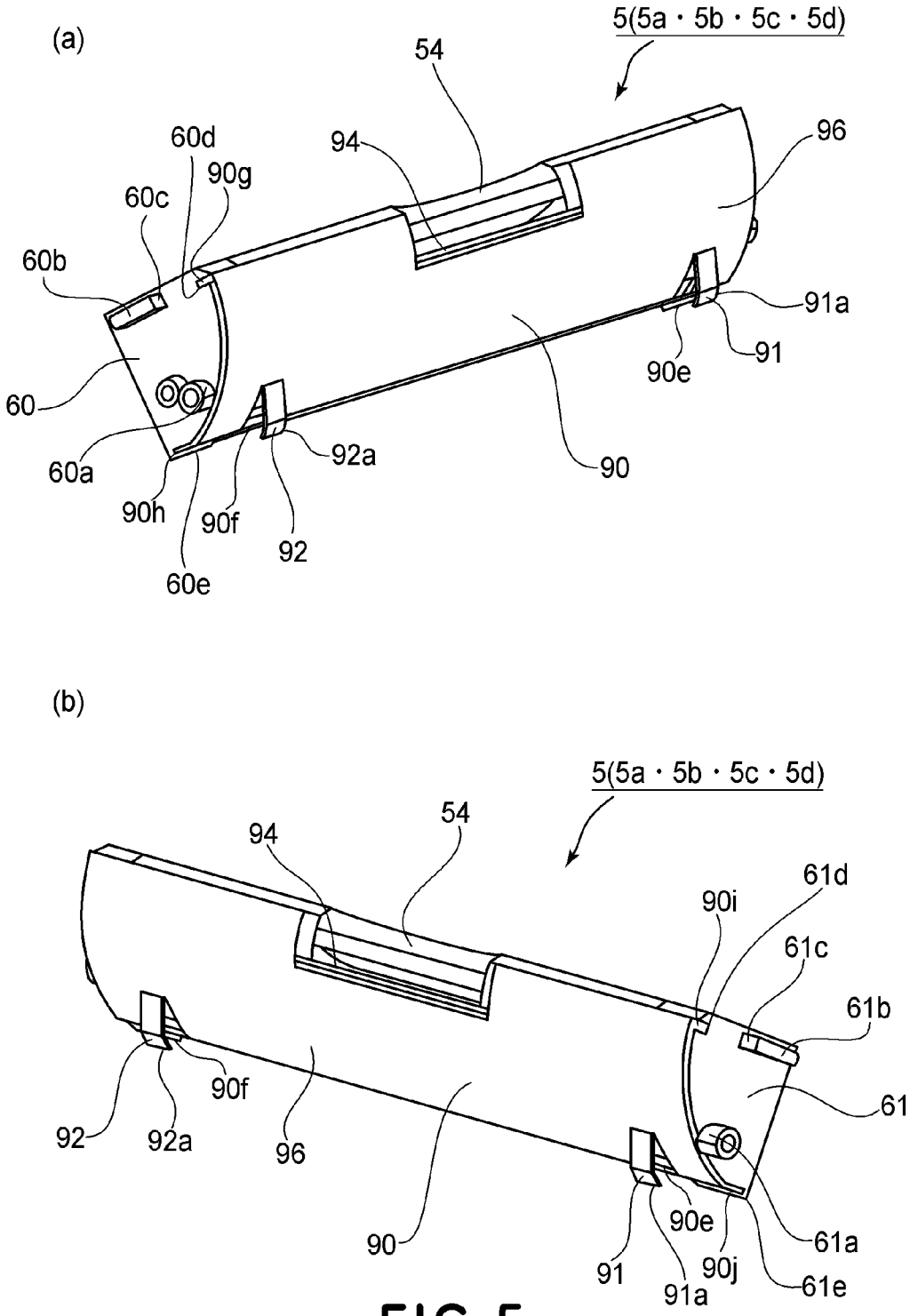
FIG. 5 is perspective views of the developing cartridge having the development covering member mounted thereto.
Figure 6:
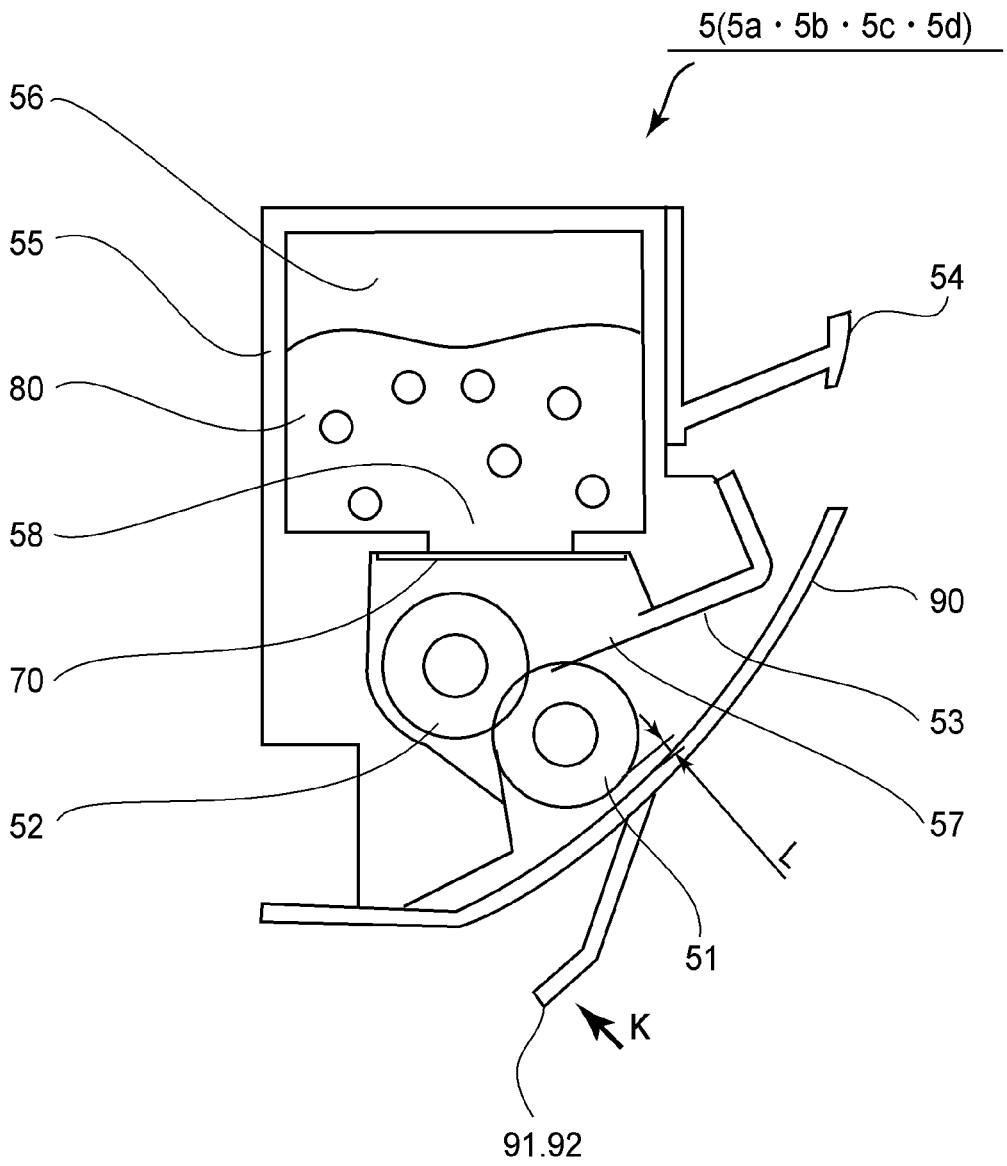
FIG. 6 is a schematic sectional view of the developing cartridge having the development covering member mounted thereto.
Figure 7:
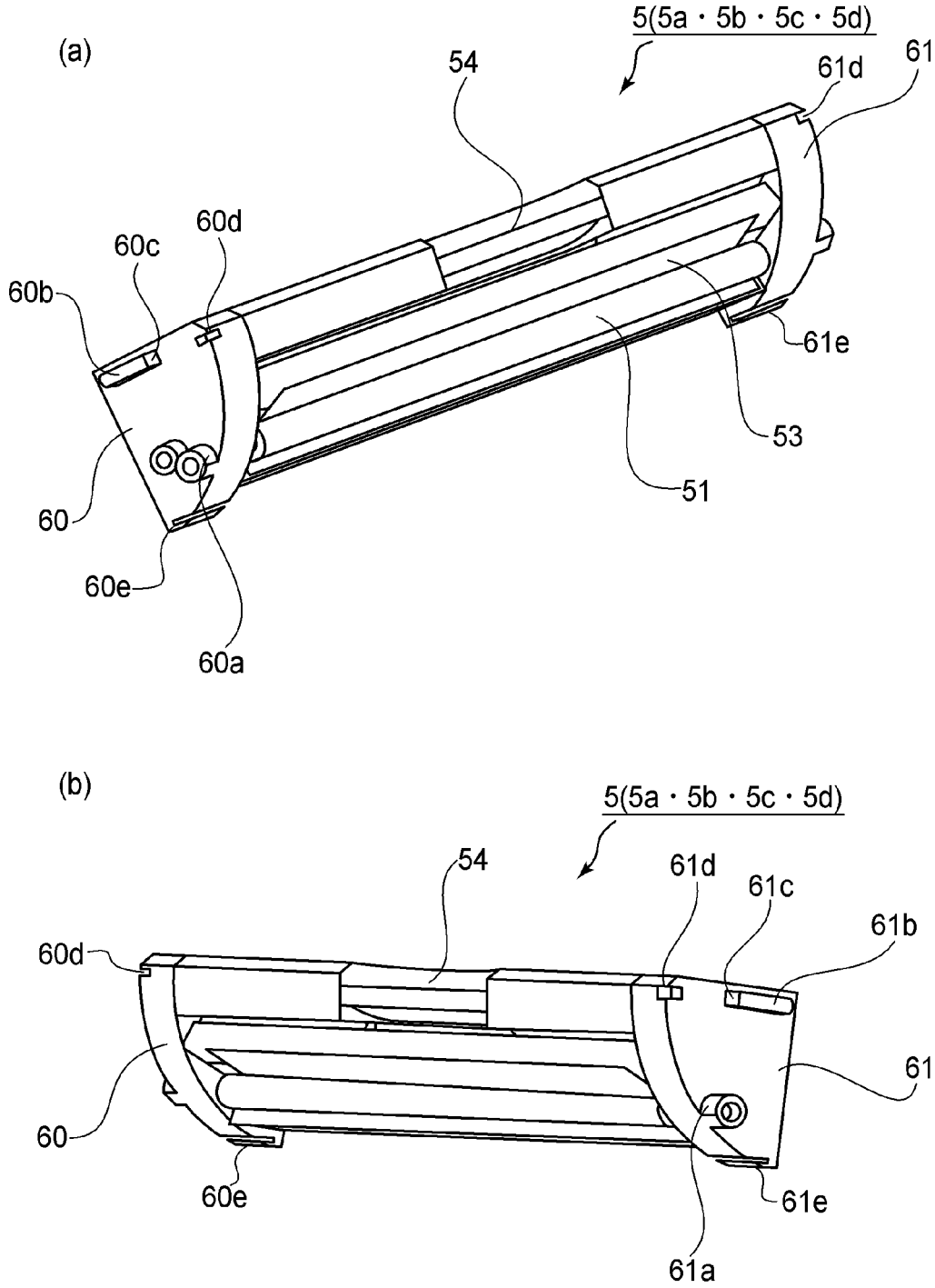
FIG. 7 is schematic perspective views of the developing cartridge not having the development covering member.
Figure 8:
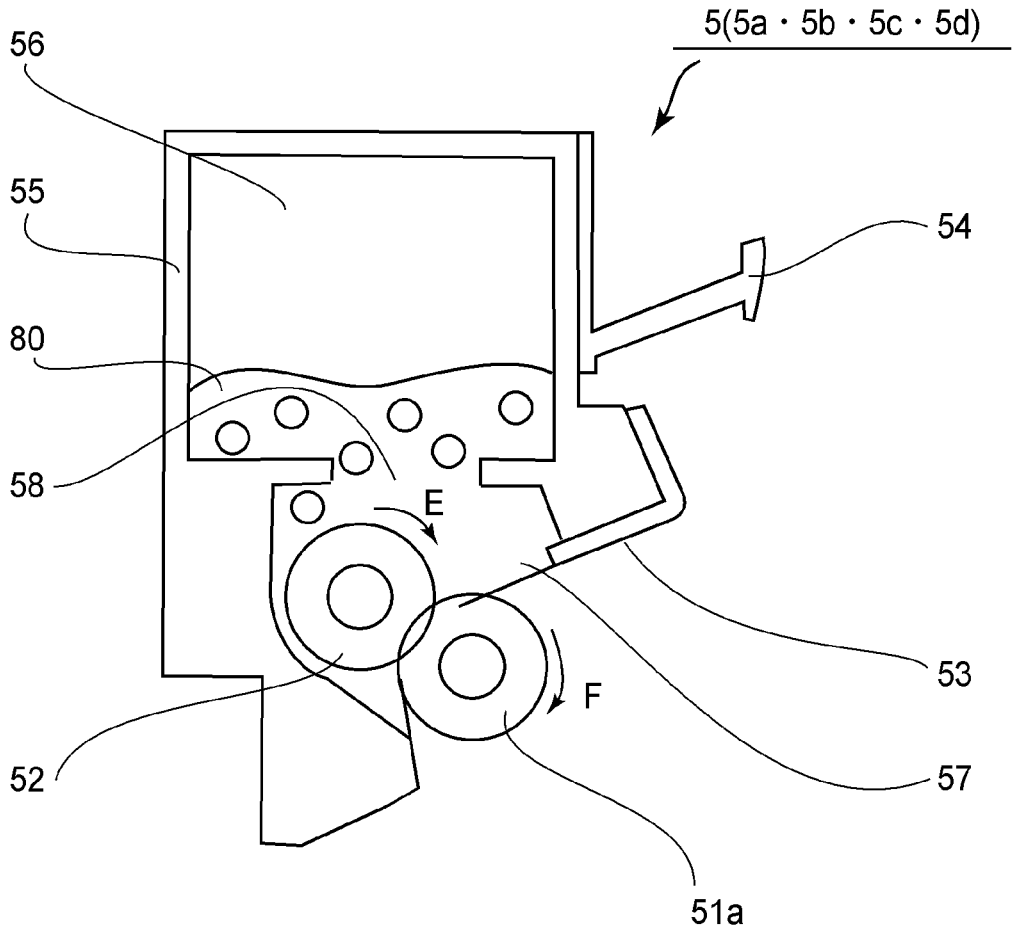
FIG. 8 is a schematic sectional view of the developing cartridge from which a toner seal is removed and from which the development covering member is removed.

It is desired that the development roller 51 is not scratched across its surface when the development cartridges 5 (5*a*, 5*b*, 5*c*, and 5*d*) are shipped out or while they are transported, and/or the development roller 51 is affected by the shipment or transportation in such a manner that it causes the image forming apparatus to form unsatisfactory images. Thus, the development cartridge 5 is provided with a cover (which hereafter may be referred to as development roller cover) for protecting the development roller 51 when the development cartridge 5 is shipped out or transported. FIGS. 5(*a*) and 5(*b*) are schematic perspective views of the development cartridge 5 fitted with the development roller cover 90, which are different in the viewing angle. FIG. 6 is a schematic cross-sectional view of the development cartridge 5 fitted with the development roller cover 90. FIGS. 7(*a*) and 7(*b*) are schematic perspective views of the development cartridge 5 after the removal of the development roller cover 90, which are different in the viewing angle. FIG. 8 is a schematic cross-sectional view of the development cartridge 5 after the removal of the toner seal and development roller cover 90.

First, referring to FIG. 6, the development cartridges 5*a*, 5*b*, 5*c*, and 5*d* have a developing means container 55, which has a toner storage chamber 56 and a development chamber 57. The toner storage chamber 56 is on top of the development chamber 57. The development chamber 57 contains the development roller 51 and a toner supply roller 52. The two chambers 56 and 57 are in connection with each other through a toner delivery opening 58, which remains sealed until the development cartridge 5 is used for the first time. The development roller 51 and toner supply roller 52 are rotatably supported by the cartridge frame. Until the development cartridges 5*a*, 5*b*, 5*c*, and 5*d* are delivered to a user, more specifically, until they are used for the first time, the toner delivery opening 58 remains sealed with a toner seal 70, which is a piece of film adhered to the developing means container 55 by thermal welding or the like method to keep the toner storage chamber 56 and development chamber 57 separated from each other. Further, the development cartridges 5*a*, 5*b*, 5*c*, and 5*d* are provided with the development roller cover 90 for protecting the development roller 51. The development cartridges 5 remain fitted with the development roller cover 90 until they are used for the first time.

Thus, before a user puts the development cartridges 5 to use for the first time, the user is to remove the toner seal 70 from the development cartridges 5*a*, 5*b*, 5*c*, and 5*d*, following a preset procedure (toner seal removal procedure). With the removal of the toner seal 70, the toner 80 in the toner storage chamber 56 enters the development chamber 57. The development cartridges 5*a*, 5*b*, 5*c*, and 5*d* are to be mounted into the predesignated development cartridge spaces, one for one, after the removal of the toner seal 70 and development roller cover 90. As a given development cartridge 5 is moved into the development position and precisely positioned therein by the rotational movement of the rotary 1, the toner 80 in the toner storage chamber 56 free-falls into the development chamber 57 through the toner delivery opening 58. Further, the development cartridge 5 receives the driving force transmitted from the apparatus main assembly 100A, and also, receives the development bias applied by the apparatus main assembly 100A. Thus, the toner supply roller 52 rotates in the direction indicated by an arrow mark E in FIG. 8, supplying thereby the development roller 51 with the toner 80. The development roller 51 is made up of an elastic rubber roller, and is rotated in the direction indicated by an arrow mark F. As the development roller 51 is rotated, the toner 80 on the development roller 51 is formed by a development blade 53 into a uniform layer of toner, the thickness of which has been preset, and then, is supplied to the drum 2*a*, in the development position. The development bias is applied to the development roller 51. Thus, the electrostatic latent image on the drum 2*a* is developed into a toner image, that is, a visible image formed of toner. The toner 80 remaining on the development roller 51 after the development is removed by the toner supply roller 52. Then, the development roller 51 is supplied again with the toner 80 by the toner supply roller 52.

(Method for Mounting Development Cartridge into Apparatus Main Assembly, and Method for Dismounting Development Cartridge from Apparatus Main Assembly)

As the development cartridges 5*a*, 5*b*, 5*c*, and 5*d* are used for image formation, the toners 80 in the development cartridges 5 are gradually consumed. Thus, each of the development cartridges 5 is provided with a detecting means (unshown) for detecting the amount of the toner 80 remaining in the development cartridge 5. The detected remaining amount of the toner 80 is compared by the control circuit 200 with a threshold value preset for informing a user of the remaining length of the service life of the development cartridge, or warning a user of the nearing end of the service life of the development cartridge. If it is detected by the control circuit 200 that the amount of the toner 80 remaining in a given development cartridge is less than the threshold value, the control circuit 200 displays, on the display portion (unshown) of the apparatus main assembly 100A, the information regarding the remaining service life of the development cartridge, or warning regarding the end of the service life of the development cartridge; a user is prompted to prepare a replacement development cartridge, or to replace the development cartridge to maintain the image forming apparatus 100 in image quality.

The operation for mounting the development cartridges 5*a*, 5*b*, 5*c*, and 5*d* into the apparatus main assembly 100A in this embodiment, and the operation for dismounting them from the apparatus main assembly 100A, are as follows:

Unless the image forming apparatus 100 is forming images, the rotary 1 remains on standby in its standby position after it is rotated about its rotational shaft 1*a* into the standby position, in which the development roller 51 of the development cartridge 5 remains separated from the drum 2*a*. Referring to FIG. 1, the image forming apparatus 100 in this embodiment is structured so that when the image forming apparatus 100 is kept on standby, that is, when the rotary 1 is in its home position, the yellow development cartridge 5*a* faces the front side of the apparatus main assembly 100A (rightward in FIG. 1). More specifically, the home position of the rotary 1 is such that when the rotary 1 is in its home position, the yellow development cartridge 5*a* is positioned 45° upstream from the development position in terms of the positive rotational direction of the rotary 1. The home position of the rotary 1, in terms of the angle from the development position, is the rotary position which allows the development cartridges to be mounted into, or removed from, the rotary 1.

Figure 9:
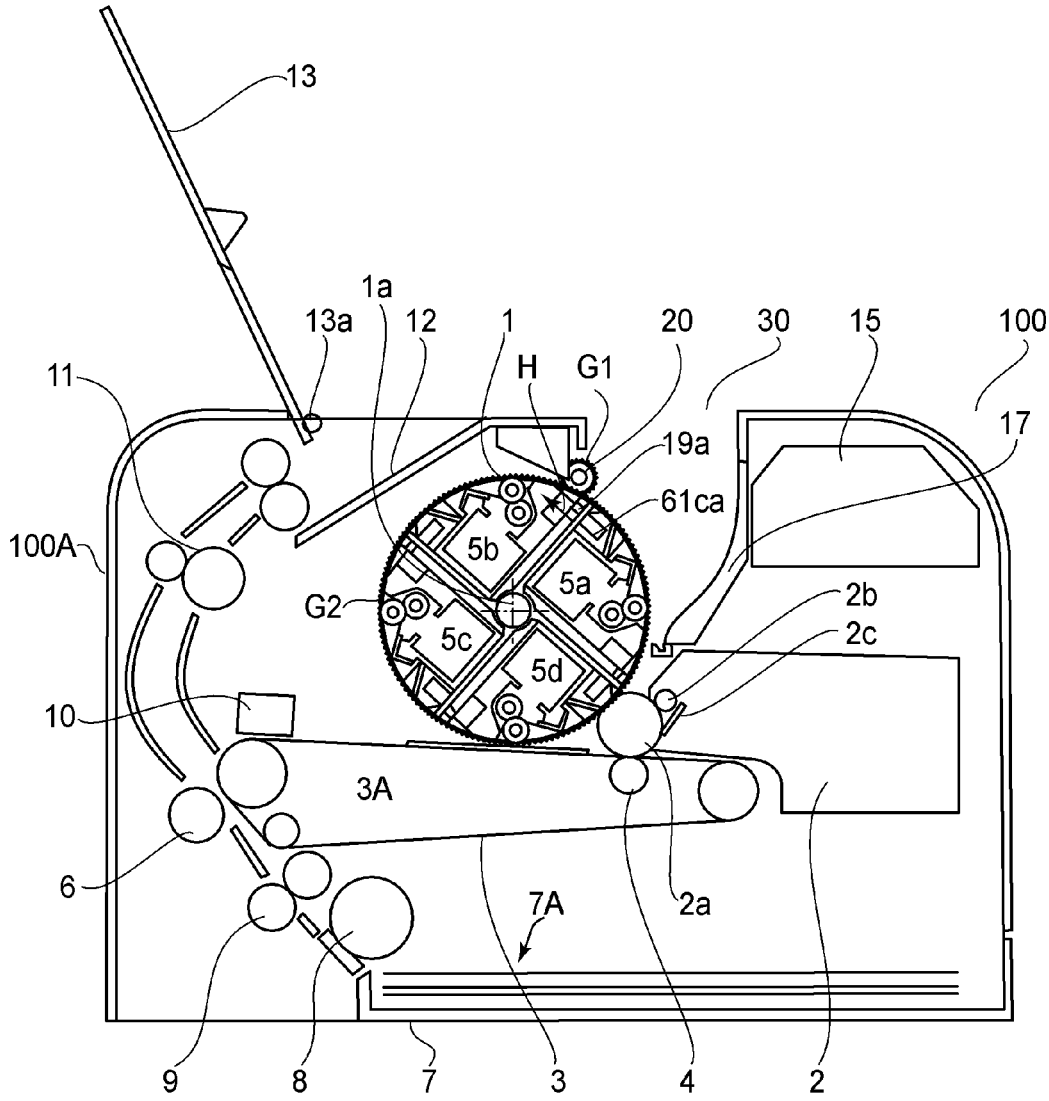
FIG. 9 is a schematic sectional view of the image forming apparatus in which a mounting and demounting cover is opened.

Opening the cover 13 (top cover) of the apparatus main assembly 100A, as shown in FIG. 9, when the image forming apparatus 100 is kept on standby as shown in FIG. 1, makes it possible for a user to access the development cartridge in its designated development cartridge space in the rotary, which is facing frontward, by inserting the user's hand into the apparatus main assembly 100A through the top opening 30 of the apparatus main assembly 100A.

As the top cover 13 is opened, the development cartridge (which in this case is yellow development cartridge 5*a*) is disengaged from the rotary 1 by the mechanism which is moved by the opening and closing movement of the top cover 13. More specifically, as the top cover 13 is opened, the cartridge engaging member 19*a*, which is in engagement with the yellow development cartridge 5*a*, is made to retract by the opening movement of the top cover 13 in the direction indicated by an arrow mark H by the mechanism, to a position in which it does not engage with the rotary engaging portion 61*ca* of the yellow development cartridge 5*a*. In other words, only the yellow development cartridge 5*a*, which is in the cartridge mounting-and-dismounting position, is disengaged from the rotary 1. Thus, if a user wanted to replace the old yellow development cartridge 5*a* in the rotary 1 with a new one, the user is to follow the following procedure: First, the user is to grasp the handle 54 of the yellow development cartridge 5*a*, and move it out of the apparatus main assembly 100A through the opening 30 by lifting the yellow development cartridge 5*a* along the cartridge mounting-and-dismounting guide 17. Next, the user is to remove the toner seal 70 and development roller cover 90 from a brand-new yellow development cartridge 5*a*, grasp the handle 54 of the new yellow development cartridge 5*a*, insert the new yellow development cartridge 5*a* into the apparatus main assembly 100A through the opening 30, and move the yellow development cartridge 5*a* toward the rotary 1 along the guiding member 17. Then, the user is to insert the yellow development cartridge 5*a* into the yellow development cartridge space of the rotary 1, and close the top cover 13. As the top cover 13 is closed, the yellow development cartridge engaging member 19*a* of the rotary 1 is moved by the abovementioned mechanism, which is moved by the opening and closing movement of the top cover 13, into the position in which the yellow development cartridge engaging member 19*a* of the rotary 1 remains engaged with the rotary engaging portion 61*ca* of the yellow development cartridge 5*ca*. Thus, the new yellow development cartridge 5*a* remains properly held thereafter in the rotary 1.

The yellow development cartridge 5*a* is mountable or removable when the image forming apparatus 100 is kept on standby in the above described condition. The other development cartridges 5, that is, the magenta, cyan, and black development cartridges 5*b*, 5*c*, and 5*d*, respectively, are also mountable or removable in the same manner as the manner in which the yellow development cartridge 5*a* is mounted and dismounted, when they are in the cartridge mounting-and-dismounting position, which is 45° upstream in terms of the positive rotational direction of the rotary 1 from the development position. That is, the user is to open the top cover 13, and rotate the rotary 1, manually or with the use of the driving force transmitting mechanism M, until its development cartridge space for the development cartridge to be mounted or replaced moves into the cartridge mounting-and-dismounting position. As the rotary is rotationally moved to the development cartridge to be replaced, into the cartridge mounting-and-dismounting position, the cartridge engaging portion of the rotary is moved by the movement of the rotary, into the position in which it does not engage with the rotary engaging portion of the cartridge. Thus, this development cartridge can be replaced with a brand-new development of the same kind, through the same procedure as that through which the old yellow development cartridge 5*a* was replace with a brand-new yellow development cartridge 5*a*.

(Shipment of Pre-Loaded Image Forming Apparatus)

Figure 11:
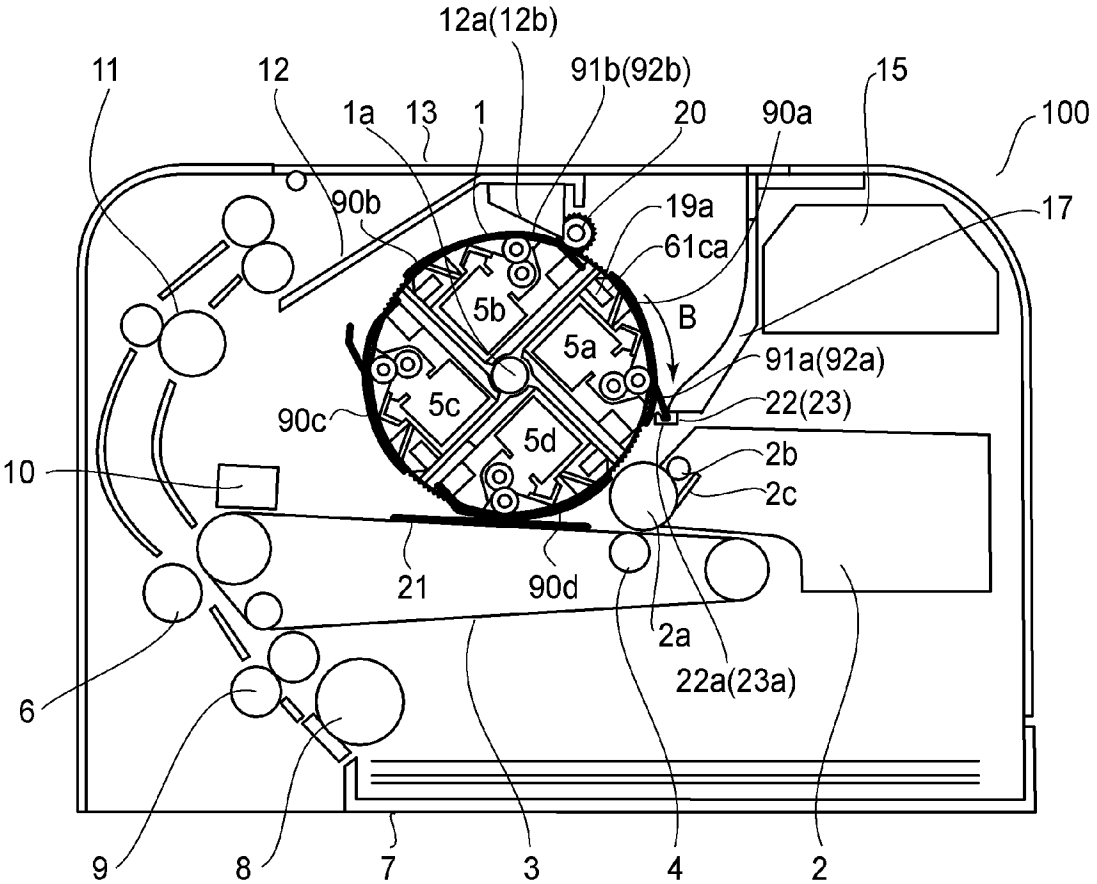
FIG. 11 is a schematic sectional view of an image forming apparatus which is packed together with the developing cartridge.
Figure 12:
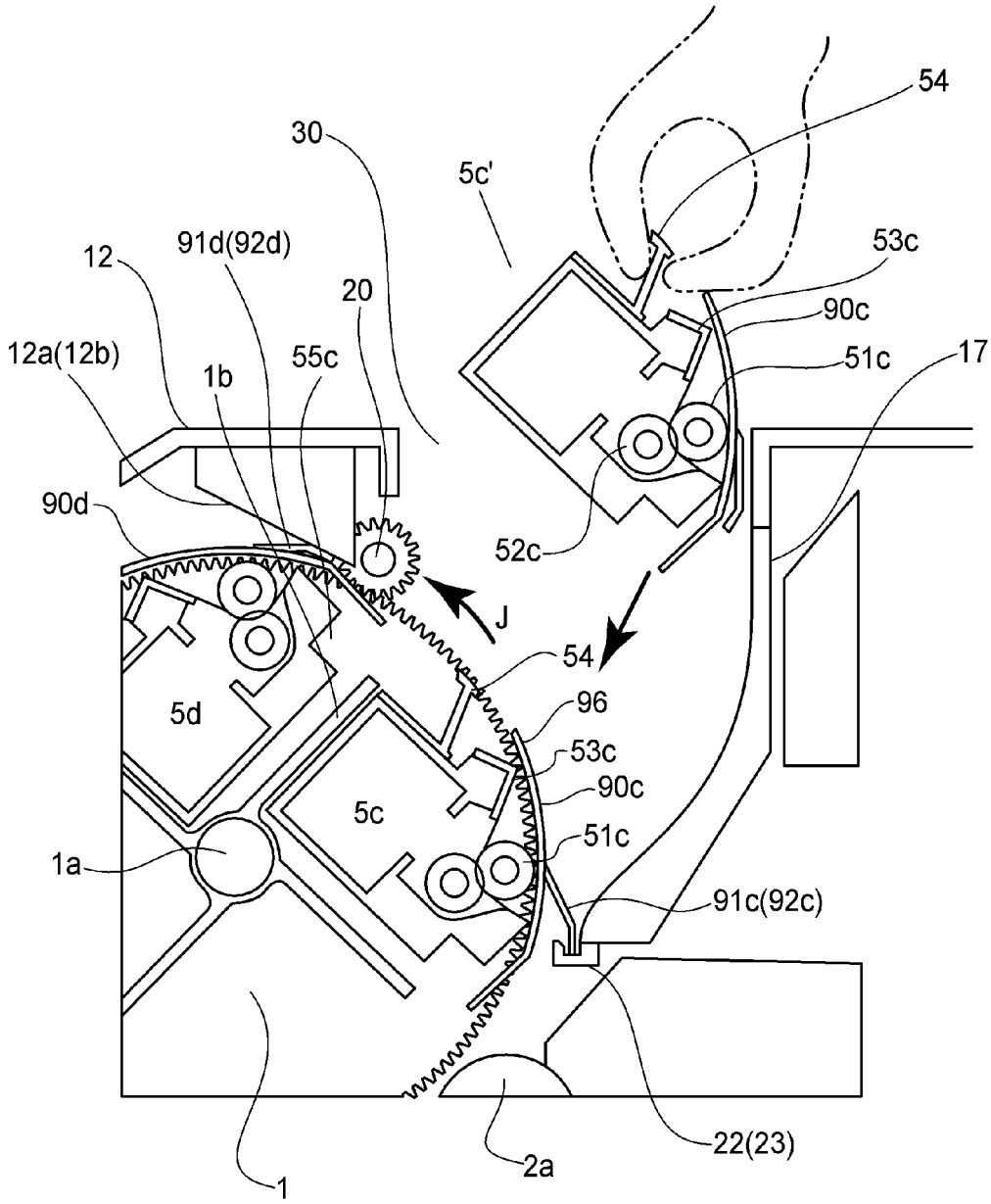
FIG. 12 is an illustration of packing the apparatus and the developing cartridge together.
Figure 13:
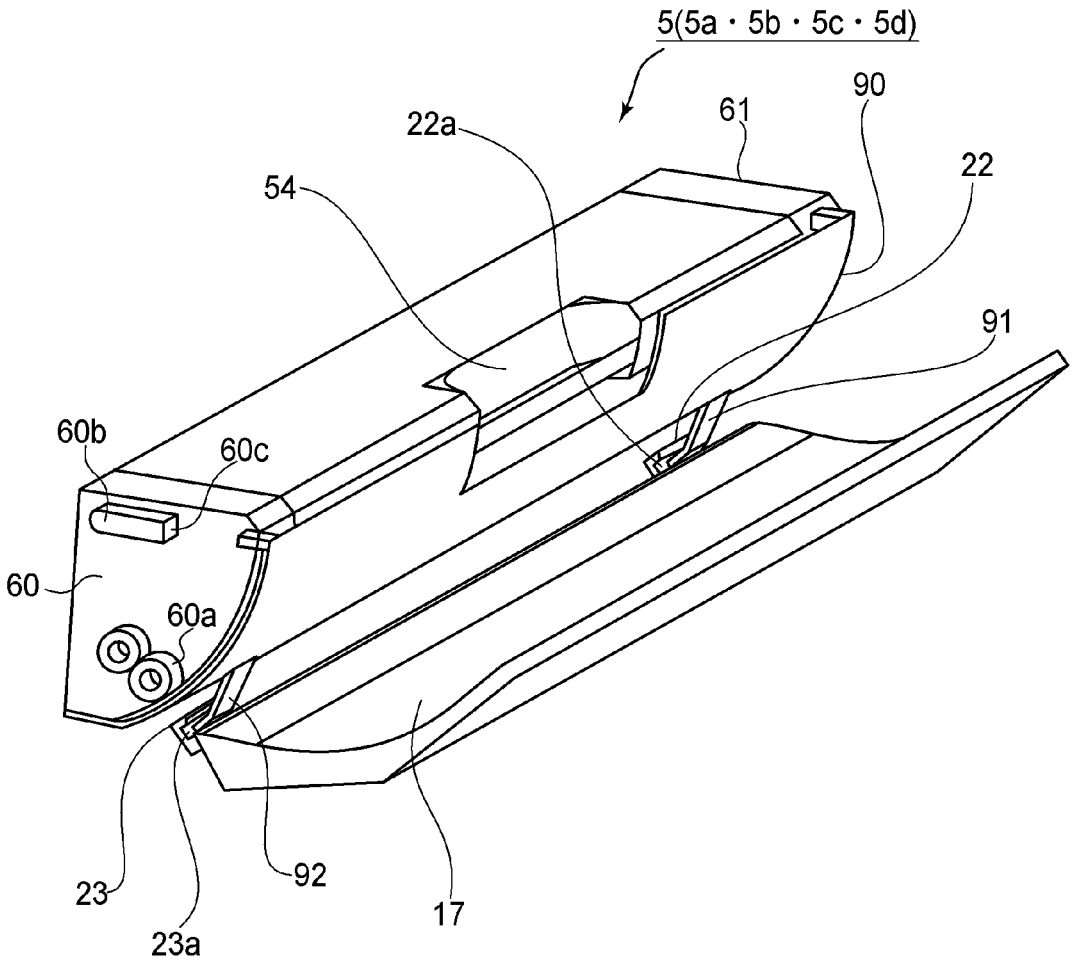
FIG. 13 is a schematic perspective view of a development cartridge mounting guide.

FIG. 11 is a schematic sectional view of the main assembly 100A of the image forming apparatus 100, which is holding four development cartridges 5 (5*a*, 5*b*, 5*c*, and 5*d* fitted with development roller covers 90 (90*a*, 90*b*, 90*c*, and 90*d*), respectively, in its designated development cartridge spaces, one for one. FIG. 12 is a schematic sectional view of the main assembly 100A of the image forming apparatus 100, into which one of the development cartridges, more specifically, cyan development cartridge 5*c*, fitted with the development roller cover 90 (90*c*) is being mounted. FIG. 13 is a perspective view of the development cartridge mounting guide.

Here, "pre-loaded shipment" means shipping an image forming apparatus, the main assembly (rotary) of which is holding one or more development cartridges. In the case of this embodiment, it means shipping the image forming apparatus 100, the main assembly (rotary) of which is holding four development cartridges 5*a*, 5*b*, 5*c*, and 5*d*.

Referring to FIG. 11, when the image forming apparatus 100 is shipped with the development cartridges 5*a*, 5*b*, 5*c*, and 5*d*, the development cartridges 5 are fitted with development roller covers 90 (90*a*, 90*b*, 90*c*, and 90*d*), respectively, and are mounted in the rotary 1.

First, referring to FIGS. 5-7, the development cartridge 5 fitted with the development roller cover 90 will be described. The development roller cover 90 is attached to each of the development cartridges 5*a*, 5*b*, 5*c*, and 5*d* in such a manner that the development roller 51 is covered across the entirety of its peripheral surface. In other words, the development roller cover 90 is a member for making it impossible for a user to directly touch the development roller 51.

In this embodiment, the lateral member 60 of the development cartridge 5 is provided with a pair of slits 60*d* and 60*e*, and the lateral member 61 of the development cartridge 5 is provided with a pair of slits 61*d* and 61*a*, whereas the development roller cover 90 is provided with ribs 90*g*, 90*h*, 90*i*, and 90*j*. The ribs 90*g* and 90*h* of the development roller cover 90 are inserted into the slits 60*d* and 60*e*, respectively, of the lateral member 60, respectively, and the ribs 90*i* and 90*j* of the development roller cover 90 are inserted into the slits 61*d* and 61*e*, respectively, of the lateral member 61, whereby the development roller cover 90 remains attached to the development cartridge 5. Although the development roller cover 90 in this embodiment is attached to the development cartridge 5 by inserting the ribs of the development roller cover 90 into the corresponding slits of the development cartridge 5, the method for attaching the development roller cover 90 to the development cartridge 5 does not need to be limited to the one used in this embodiment. That is, the means for keeping the development roller cover 90 attached to the development cartridge 5 is optional.

The development roller cover 90 is formed of resin, and is 0.5-2 mm in thickness. It is given orange color for better visibility. However, this embodiment is not intended to limit the development roller cover 90 in color; the color is optional.

Referring to FIG. 6, after the attachment of the development roller cover 90 to the development cartridge 5, there is a preset amount of gap L between the development roller cover 90 and development cartridge 5. In this embodiment, this gap L is maintained by placing the lengthwise ends of the development roller cover 90 in contact with a part of the lateral member 60 of the development cartridge 5, and a part of the lateral member 61 of the development cartridge 5. The gap L is in a range of 0.5-3 mm. Incidentally, it does not matter whether there is a gap between the development roller cover 90 and development blade 53, or not.

Further, the development roller cover 90 has a recess 94, which allows the handle 54 of the development cartridge 5 to remain exposed even when the development roller cover 90 is on the development cartridge 5. Therefore, even when the development roller cover 90 is on the development cartridge 5, a user can hold the development cartridge 5 by the handle 54.

The lengthwise end portions of the development roller cover 90 are provided with a pair of main assembly engaging portions 91 and 92, one for one, which are integrally formed with the main portion of the development roller cover 90 and can be elastically retracted in the direction indicated by an arrow mark K (FIG. 6) to be fitted into the holes 90*e* and 90*f*, with which the development roller cover 90 is provided. The main assembly engaging portions 91 and 92 may be a pair of members formed independently from the development roller cover 90, as long as they can function as satisfactorily as the main assembly engaging members 91 and 92 in this embodiment.

The lateral members 60 and 61 of the development cartridge 5 are provided with a pair of shaft portions 60*a* and 61*a*, a pair of guiding portions 60*b* and 61*b*, and a pair of rotary engaging portions 60*c* and 61*c*, respectively, which are on the outward side of the lateral members 60 and 61, being symmetrically positioned relative to their counterparts.

Next, referring to FIG. 12, the procedure for shipping the image forming apparatus 100, which is holding the development cartridges 5*a*, 5*b*, 5*c*, and 5*d* fitted with the development roller covers 90*a*, 90*b*, 90*c*, and 90*d*, respectively, in its main assembly 100A will be described.

To simply describe the flow of the operation, first, the top cover 13 is to be opened. Then, the rotary 1 is to be rotated so that its designated space for the first development cartridge 5 to be mounted moves into the cartridge mounting-and-dismounting position. Then, the development cartridge 5 is to be inserted into the space in the rotary 1 through the opening 30, with the development roller cover 90 remaining attached to the development cartridge 5.

Then, the rotary 1 is to be rotated by 90° in the direction indicated by an arrow mark J, which is opposite in direction from the positive rotational direction B of the rotary 1, and the next development cartridge 5 is mounted. This process is repeated until the last development cartridge 5 is mounted into the rotary 1. As the rotary 1 is rotated, the engaging portions 91*d* and 92*d* of the development roller cover 90 come into contact with the drive shaft 20 (first member) of the rotary 20, and pass by the drive shaft 20 by retracting as they come into contact with the drive shaft 20. The mounting of the last (fourth) development cartridge 5 completes the procedure for mounting the development cartridges 5 into the image forming apparatus 100. There is no restriction regarding the order in which the four development cartridges 5 are to be mounted into the rotary 1. In this embodiment, the development cartridge 5 is mounted in the order of the black, cyan, magenta, and yellow development cartridges 5*d*, 5*c*, 5*b*, and 5*a*, respectively. Thus, it is the yellow development cartridge 5*a* that is likely to be in the cartridge mounting-and-dismounting position when the image forming apparatus 100 is shipped out of the factory (FIG. 11). The main assembly engaging portions 91 and 92 are retractable, and therefore, the reverse rotation of the rotary 1, which occurs when mounting the development cartridges 5 into the apparatus main assembly 100A before shipping the image forming apparatus 100, creates no problem. Referring to FIG. 11, as the rotary 1 is reversely rotated, the main assembly engaging portions 91 and 92 are made to retract against their own elasticity, by the drive shaft 20 of the rotary 1, slanted surfaces 12*a* and 12*b*, shielding member 21, and cartridge engaging members 22 and 23 of the apparatus main assembly 100A. In other words, whether the rotary 1 is positively rotated or negatively rotated does not affect the operational efficiency.

Next, referring to FIGS. 11 and 13, the development cartridges 5 mounted in the apparatus main assembly 100A without the removal of the development roller cover 90 will be described.

When the yellow development cartridge 5*a* fitted with the development roller cover 90*a* is in its designated space in the rotary 1, the engaging ends 91*a* and 91*b* of the main assembly engaging portions 91 and 92 of the development roller cover 90*a* are engaged in the grooves 22*a* and 23*a* of the development cartridge engaging portion of 22 and 23 (i.e., main assembly side engaging portion), respectively. This position in which the yellow development cartridge 5*a* is when the ends 91*a* and 91*b* of the engaging portions 91 and 92 of the development roller cover 90*a* are in the grooves 22*a* and 23*a* of the development cartridge engaging portions 22 and 23, respectively, corresponds to the cartridge mounting-and-dismounting position for the yellow development cartridge 5*a*. Therefore, unless a user removes the development roller cover 90*a* after the unpacking of the image forming apparatus 100, the rotary 1 cannot be rotated in the positive direction. Should the top cover 13 be closed without the removal of the development roller cover 90*a*, the rotation of the motor for driving the rotary 1 in the positive direction becomes abnormal, prompting the user to remove the development roller cover 90*a*. In this embodiment, the abnormal rotation of the motor is utilized to prompt the user to remove the development roller cover 90*a*. However, the detecting means other than the motor for rotating the rotary 1 can be used without causing any problem.

Referring to FIG. 13, the main assembly engaging portions 91 and 92 of the development roller cover 90 are at the lengthwise ends of the development cartridge 5, and the apparatus main assembly 100A is structured so that its development roller engaging portions 22 and 23 correspond in position to the lengthwise end portions of the development cartridge 5 in the rotary 1. Further, these portions are outside the scanning range of the laser scanner unit 15. That is, in terms of the direction parallel to the axial line of the development roller 51, the main assembly engaging portions 91 and 92 are positioned so that they are outside the maximum image formation range of the drum 2*a*, and on the inward side of the lengthwise ends of the drum 2*a*. Providing both lengthwise end portions of the development cartridge 5 with the main assembly engaging portions 91 and 92, one for one, and providing the lengthwise end portions of the main assembly 100A with the development roller cover engaging portions 22 and 23, one for one, can significantly reduce in amount the load to which the lengthwise end portions (91 or 92) of the development roller cover 90 would be subjected if it is only one of the length end portions of the development roller cover 90 that is provided with the main assembly engaging portion (91 or 92).

Because the rotary 1 does not rotate, a user is reminded that the development roller cover 90*a* has to be removed from the yellow development cartridge 5*a*. Thus, the user takes the yellow development cartridge 5*a* out of the rotary 1, and removes the development roller cover 90*a* from the yellow development cartridge 5*a*. Then, the user mounts the yellow development cartridge 5*a* into the designated yellow development cartridge space in the rotary 1. Thus, it becomes possible for the rotary 1 to be rotationally moved for the first time after the arrival of the brand-new image forming apparatus 100.

Next, the user is to rotate the rotary 1 in the positive direction. As the rotary 1 is rotated in the positive direction, the end portions of the main assembly engaging portions 91*b* and 92*b* of the development roller cover 90*b* on the magenta development cartridge 5*b* engage with the development cartridge cover engaging portions 22 and 23, respectively, of the apparatus main assembly 100A, stopping thereby the rotary 1. The position in which the rotary 1 stops corresponds to the development cartridge mounting-and-dismounting position. Thus, the user is to remove the magenta development cartridge 5*b* from the rotary 1, remove the development roller cover 90*b* from the magenta development cartridge 5*b*, and mount the magenta development cartridge 5*b* back into the designated magenta development cartridge space in the rotary 1.

The above described operation for removing the development cartridge from the rotary 1, removing the development roller cover 90 from the development cartridge, and mounting the development cartridge into its designated place in the rotary 1, is to be repeated for both the cyan development cartridge 5*c* and black development cartridge d.

That is, the mounting of the black development cartridge 5*d*, which is free of the development roller cover 90*d*, into the designated black development cartridge space in the rotary 1 completes the operational sequence for preparing the brand-new image forming apparatus 100 for the first time usage after the arrival of the image forming apparatus 100.

The removal of all the development roller covers 90 (90*a*, 90*b*, 90*c*, and 90*d*) from all four development cartridges 5 (5*a*, 5*b*, 5*b*, and 5*c*) makes it possible for the rotary 1 to be continuously rotated in the positive direction B.

Next, what occurs to the development roller cover 90 when the rotary 1 is manually rotated will be described. Referring to FIG. 11, the slanted surfaces 12*a* and 12*b*, with which the top cover 12 is provided, are the means for causing the main assembly engaging portions 91*b* and 92*b* of the development roller cover 90*b* on the magenta development cartridge 5*b* to retract when the rotary 1 is rotated in the direction indicated by the arrow mark B. Without the slanted surfaces 12*a* and 12*b*, it is possible that the main assembly engaging portions 91*b* and 92*b* will interfere with the rotary driving shaft 20, which may prevent the rotary 1 from rotationally moving the magenta development cartridge 5*b* into its development position, and/or may result in the damage to the development roller cover 90*b*. The apparatus main assembly 100A is structured so that when the magenta development cartridge 5*b* is in its designated position in the rotary 1, the slanted surfaces 12*a* and 12*b* (second members) corresponds in position to the main assembly engaging portions 91*b* and 92*b* of the development roller cover 90*b*, respectively.

Next, referring to FIG. 11, when the black development cartridge 5*b* is in the above described position, the development roller cover 90*d*, which is on the black development cartridge 5*d* which is on the opposite side of the rotary 1 in terms of the diameter direction of the rotary 1, is in such a state that its main assembly engaging portions 91*d* and 92*d* remain retracted by the shielding member 21 (i.e., a preventing member) on the transfer belt 3. Without the shielding member 21, the main assembly engaging portions 91*d* and 92*d* interfere with the transfer belt 3, which may result in surface damage to the transfer belt 3, which in turn may result in the formation of unsatisfactory images.

As described above, from the standpoint of placing the development roller cover 90 in the limited internal space of the main assembly 100A, it is very effective for the main assembly engaging portions 91*a* and 92*a* of the development roller cover 90, which project from the arcuate outward surface 96 of the development roller cover 90, to be retractable.

Also referring to FIG. 11, when the image forming apparatus 100 is in the state shown in FIG. 11, the main assembly engaging portions 91*c* and 92*c* of the cyan development cartridge 5*c* remain protruding from the outward surface 96 of the development roller cover 90*c*. However, the apparatus main assembly 100A may be structured so that the main assembly engaging portion 91*c* and 92*c* of the development cartridge 5*c* come into contact with a part of the apparatus main assembly 100A, and remain retracted by the part of the apparatus main assembly 100A.

What was said above regarding the magenta, cyan, and black development cartridges 5*b*, 5*c*, and 5*d* when the magenta development cartridge 5*b* was in the abovementioned position can be also said when the cyan development cartridge 5*c*, black development cartridge 5*d*, and yellow development cartridge 5*a* are in the position in which the magenta development cartridge 5*b* was.

The above described structural arrangement may be summarized as follows. The image forming apparatus 100 has: the rotatable rotary 1, which removably holds the multiple development cartridges 5*a*, 5*b*, 5*c*, and 5*d*; and development cartridge engaging members 22 and 23 for preventing the rotary 1 from rotating in the direction in which the rotary 1 is rotated for image formation. Each of the development cartridges 5*a*, 5*b*, 5*c*, and 5*d* has at least the development roller 51, which is the developer bearing member for developing the latent image formed on the drum 2*a*, which is an image bearing member; and a development roller cover 90 which covers the peripheral surface of the development roller 51. The development roller cover 90 is provided with the pair of main assembly engaging portions 91 and 92, which engage with the cartridge engaging portions 22 and 23 of the apparatus main assembly 100A. The main assembly engaging portions 91 and 92 are flexible, being thereby enabled to take the first position, in which they engage with the development roller cover engaging portions 22 and 23 of the apparatus main assembly 100A, and the second position in which they are prevented from diagonally projecting from the outward surface 96 of the development roller cover 90. The second positions of the main assembly engaging portions 91 and 92 are the only positions into which the main assembly engaging portions 91 and 92 are moved by their contact with the first members of the main assembly 100A of the apparatus main assembly 100A, except for the development cartridge mounting-and-dismounting position in which the development cartridges are mounted into, or dismounted from, the apparatus main assembly 100A. The second positions for the main assembly engaging portions 91 and 92 are also the positions into which the main assembly engaging portions 91 and 92 are moved from their first position by their contact with the members of the main assembly 100A of the image forming apparatus 100, other than the positions into which they are moved when the development cartridges are mounted into, or dismounted from, the rotary 1, that is, when the rotary 1 is rotated in the direction J, which is opposite to the direction B in which the rotary 1 is rotated during an image forming operation, These positions allow the rotary 1 to be rotated in the reverse direction J.

Because the image forming apparatus 100 is structured as described above, the development roller cover 90, which is covering the peripheral surface of the developer bearing member, engages with the development roller cover engaging portions of the apparatus main assembly 100A, when a user unpacks the packaged image forming apparatus 100. This engagement stops the rotational movement of the rotary 1, making it easier for a user to realize that the user forgot to remove the development roller cover(s) 90. Thus, the above described structural arrangement can minimize in amount the operation which the user has to perform to replace the development cartridge(s). Moreover, should the user forget to remove the development roller cover of one of the development cartridges, the user will be reminded of the error when the development cartridge in question is in the development cartridge mounting-and-dismounting position.

Next, the procedure for mounting the yellow development cartridge 5*a* after the removal of the development roller cover 90*a* will be described.

The yellow, magenta, cyan, and black development cartridges 5*a*, 5*b*, 5*c*, and 5*d*, respectively, are the same in structure. Here, therefore, the structure of the yellow development cartridge 5*a* will be described as the example of their structure in this embodiment.

Figure 10:
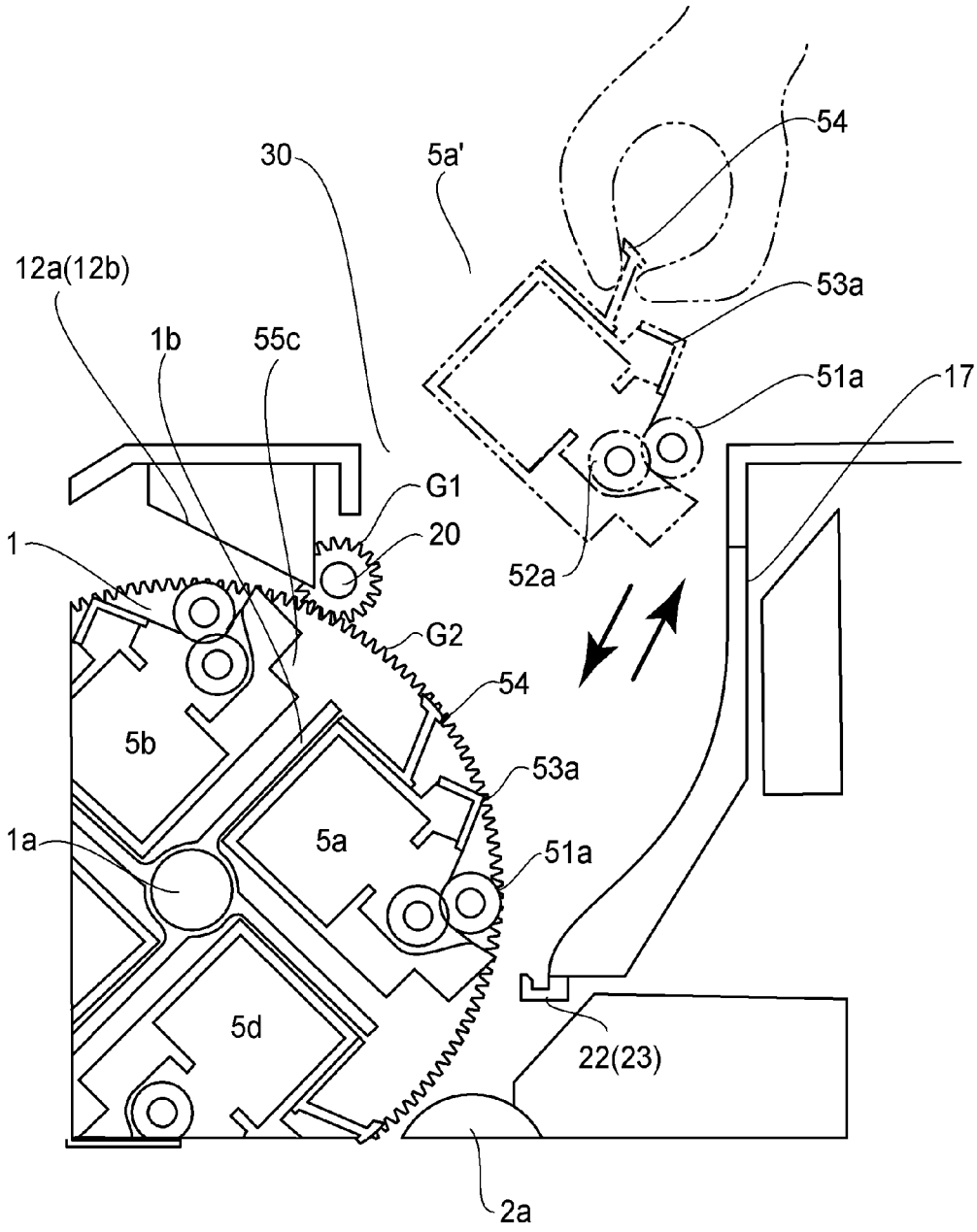
FIG. 10 is an illustration of mounting and demounting manner of the developing cartridge.

Referring to FIG. 10, as a user picks up the yellow development cartridge 5*a* by grasping the handle 54 of the yellow development cartridge 5*a*, the posture of the yellow development cartridge 5*a* becomes similar to the posture in which the yellow development cartridge 5*a* will be if the yellow development cartridge 5*a* is in the development cartridge mounting-and-dismounting position in the apparatus main assembly 100A. When the yellow development cartridge 5*a* is in this posture, the user's hand, which is holding the handle 54, is not in contact with the development roller 51*a*.

Also referring to FIG. 10, as the yellow development cartridge 5*a* is mounted into the rotary 1, it follows the development cartridge guide 17, being thereby guided into its designated space created by the divider plates 1*b*, which divide the internal space of the rotary 1 into four development cartridge spaces, which are angled 90° at their corners next to the rotational shaft 1*a*. Each of the designated development cartridge spaces of the rotary 1 is provided with a pair of development cartridge positioning portions 1*d* (FIG. 4). Thus, as the yellow development cartridge 5*a* is mounted into its designated space in the rotary 1, the peripheral surface of the shaft portion 60*a* of the lateral member 60 of the development cartridge 5*a*, and the peripheral surface of the shaft portion 61*a* of the lateral member 61 of the development cartridge 5*a*, which are shown in FIG. 7, come into contact with the pair of developer cartridge positioning portions 1*d*, one for one, whereby the yellow development cartridge 5*a* is precisely positioned relative to the rotary 1. In this embodiment, the shaft portions 60*a* and 61*a* are coaxial with the development roller 51*a*. This setup, however, is not mandatory.

In the above, the present invention was described using an electrophotographic image forming apparatus as an example. Obviously, the present invention is also applicable to an electrostatically recording image forming apparatus and a magnetically recording image forming apparatus, with the effects similar to those described above.

According to the present invention which relates to an image forming apparatus, as a user starts an image forming apparatus for the first time after unpacking the image forming apparatus, the main assembly engaging portions of the development roller surface covering member of the development cartridge in the development roller mounting-and-dismounting position in the apparatus main assembly engage with the development roller covering member engaging portions of the apparatus main assembly, whereby the rotary is stopped. Thus, the user can easily determine that the user has forgotten to remove the development roller cover.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 223404/2008 filed Sep. 1, 2008 which is hereby incorporated by reference.

What is claimed is:

1. An image forming apparatus forming an image on a recording material, comprising:

an image bearing member;

a rotary rotatably provided in a main assembly of the apparatus;

a main assembly side engaging portion; and a developing cartridge detachably mounted to said rotary, wherein said developing cartridge includes a developer carrying member for developing a latent image formed on said image bearing member, a demountably mounted covering member for covering a surface of said developer carrying member, wherein said covering member has a cartridge side engaging portion movable between (i) a first position in which said cartridge side engaging position engages with said main assembly side engaging portion when said rotary is rotated, and (ii) a second position in which said cartridge side engaging portion is retracted from the first position so as not to engage with said main assembly side engaging portion.

2. An apparatus according to claim 1, wherein said cartridge side engaging portion is provided outside each of lateral ends of a maximum image forming width of said image bearing member.

3. An apparatus according to claim 1, wherein said cartridge side engaging portion is moved to the second position from the first position by contacting to a first member provided in said main assembly of the apparatus when said rotary is rotated in a backward direction, which is opposite a forward direction during image formation, thus permitting rotation of the rotary in the backward direction.

4. An apparatus according to claim 3, wherein said first member is a driving shaft provided with a gear for rotating said rotary.

5. An apparatus according to claim 3, further comprising a second member for moving said cartridge side engaging portion from the first position to the second position to prevent the rotation prevention by said cartridge side engaging portion contacting to said first member when said rotary rotates in the forward direction.

6. An apparatus according to claim 1, further comprising a belt member for transferring a developed image formed on said image bearing member, and a preventing member for moving said cartridge side engaging portion from the first position to the second position to prevent abutment between said cartridge side engaging portion and said belt member when said rotary rotates.

7. An apparatus according to claim 1, wherein said cartridge side engaging portion engages with said main assembly side engaging portion to prevent said rotary from rotating.

8. An image forming apparatus forming an image on a recording material, comprising:

an image bearing member;

a rotary rotatably provided in a main assembly of the apparatus;

a main assembly side engaging portion; and a developing cartridge detachably mounted to said rotary, wherein said developing cartridge includes a developer carrying member for developing a latent image formed on said image bearing member, a demountably mounted covering member for covering a surface of said developer carrying member, and a cartridge side engaging portion which is movable between (i) a first position in which it is projected beyond an outer surface of said covering member to engage with said main assembly side engaging portion when said rotary is rotated in a forward direction which is a direction of rotation during image formation, and (ii) a second position in which said cartridge side engaging portion is retracted from the first position so as not to engage with said main assembly side engaging portion.

9. An apparatus according to claim 8, wherein said cartridge side engaging portion is provided outside each of lateral ends of a maximum image forming width of said image bearing member.

10. An apparatus according to claim 8, wherein said cartridge side engaging portion is moved to the second position from the first position by contacting to a first member provided in said main assembly of the apparatus when said rotary is rotated in a backward direction, which is opposite the forward direction, thus permitting rotation of the rotary in the backward direction.

11. An apparatus according to claim 10, wherein said first member is a driving shaft provided with a gear for rotating said rotary.

12. An apparatus according to claim 10, further comprising a second member for moving said cartridge side engaging portion from the first position to the second position to prevent the rotation prevention by said cartridge side engaging portion contacting to said first member when said rotary rotates in the forward direction.

13. An apparatus according to claim 8, further comprising a belt member for transferring a developed image formed on said image bearing member, and a preventing member for moving said cartridge side engaging portion from the first position to the second position to prevent abutment between said cartridge side engaging portion and said belt member when said rotary rotates.

14. An apparatus according to claim 8, wherein said cartridge side engaging portion engages with said main assembly side engaging portion to prevent said rotary from rotating.

* * * * *